US011796929B2

(12) United States Patent
Kawabata et al.

(10) Patent No.: US 11,796,929 B2
(45) Date of Patent: Oct. 24, 2023

(54) ELECTROPHOTOGRAPHIC PHOTOCONDUCTOR, PROCESS CARTRIDGE, AND IMAGE FORMING APPARATUS

(71) Applicant: FUJIFILM BUSINESS INNOVATION CORP., Tokyo (JP)

(72) Inventors: Yukimi Kawabata, Ebina (JP); Natsumi Kaneko, Ebina (JP); Hideya Katsuhara, Ebina (JP)

(73) Assignee: FUJIFILM BUSINESS INNOVATION CORP., Tokyo (JP)

( * ) Notice: Subject to any disclaimer, the term of this patent is extended or adjusted under 35 U.S.C. 154(b) by 216 days.

(21) Appl. No.: 17/338,895

(22) Filed: Jun. 4, 2021

(65) Prior Publication Data

US 2021/0405548 A1 Dec. 30, 2021

(30) Foreign Application Priority Data

Jun. 26, 2020 (JP) ..... 2020-110735
Mar. 26, 2021 (JP) ..... 2021-054284

(51) Int. Cl.

| | |
|---|---|
| ***G03G 5/05*** | (2006.01) |
| ***G03G 5/047*** | (2006.01) |
| ***G03G 5/06*** | (2006.01) |
| ***G03G 15/08*** | (2006.01) |
| ***G03G 15/02*** | (2006.01) |

(52) U.S. Cl.
CPC ..... *G03G 5/0564* (2013.01); *G03G 5/047* (2013.01); *G03G 5/0609* (2013.01); *G03G 5/061443* (2020.05); *G03G 15/0275* (2013.01); *G03G 15/0867* (2013.01)

(58) Field of Classification Search
CPC ..... G03G 5/0564; G03G 5/061443; G03G 5/047; G03G 5/0609
See application file for complete search history.

(56) References Cited

U.S. PATENT DOCUMENTS

2018/0081287 A1* 3/2018 Nakamura ..... G03G 5/047

FOREIGN PATENT DOCUMENTS

JP 2002-365818 A 12/2002
JP 2018-049149 A 3/2018

* cited by examiner

*Primary Examiner* — Peter L Vajda
*Assistant Examiner* — Boone Alexander Evans
(74) *Attorney, Agent, or Firm* — Oliff PLC

(57) ABSTRACT

An electrophotographic photoconductor includes: a conductive substrate; and a single-layer-type photoconductive layer that is provided on the conductive substrate and contains a binder resin, a charge generating material, a hole transporting material, and an electron transporting material, in which a volume resistivity of the photoconductive layer after wear is $5.0\times10^{10}$ Ω·cm or more and $2.0\times10^{11}$ Ω·cm or less when a ratio of a thickness of the photoconductive layer after wear to a thickness of the photoconductive layer before wear (the thickness of the photoconductive layer after wear/the thickness of the photoconductive layer before wear) is 0.8.

20 Claims, 3 Drawing Sheets

ELECTROPHOTOGRAPHIC PHOTOCONDUCTOR, PROCESS CARTRIDGE, AND IMAGE FORMING APPARATUS

CROSS-REFERENCE TO RELATED APPLICATIONS

This application is based on and claims priorities under 35 USC 119 from Japanese Patent Application No. 2020-110735 filed on Jun. 26, 2020 and Japanese Patent Application No. 2021-054284 filed on Mar. 26, 2021.

BACKGROUND

Technical Field

The present invention relates to an electrophotographic photoconductor, a process cartridge, and an image forming apparatus.

Related Art

In a related-art electrophotographic image forming apparatus, a toner image formed on a surface of an electrophotographic photoconductor is transferred onto a recording medium through steps of charging, electrostatic latent image formation, development, and transfer.

For example, Patent Literature 1 discloses "an electrophotographic photoconductor including: a conductive substrate; and a single-layer-type photoconductive layer on the conductive substrate, the photoconductive layer containing a binder resin, a charge generating material, an electron transporting material, and a hole transporting material, in which a product of a volume resistivity (GΩ·m) and an elastic modulus (GPa) is 90 or more".

Further, Patent Literature 2 discloses "an image forming apparatus including: a single-layer positive-charging organic photoconductor including a photoconductive layer, which contains a charge generating substance, a hole transporting substance, an electron transporting substance, and an organic binder resin on a conductive support, and has a resistivity ρ of $\rho<10^{11}$ Ω·m (where ρ is a resistivity at an electric field strength of 20 V/μm); and a charging member configured to charge a surface of the photoconductor, in which the charging member is a non-contact charging member".

CITATION LIST

Patent Literature

Patent Literature 1: JP-A-2018-049149
Patent Literature 2: JP-A-2002-365818

SUMMARY

Aspects of non-limiting embodiments of the present disclosure relate to provide an electrophotographic photoconductor including a single-layer-type photoconductive layer containing a binder resin, a charge generating material, a hole transporting material, and an electron transporting material, in which occurrence of black spots is prevented while having a high light sensitivity, as compared with a case where a volume resistivity of the photoconductive layer after wear is less than $5.0\times10^{10}$ Ω·cm or more than $2.0\times10^{11}$ Ω·cm when a ratio of a thickness of the photoconductive layer after wear to a thickness of the photoconductive layer before wear is 0.8, or a case where a ratio of an amount of the hole transporting material on a front surface of the photoconductive layer to an amount of the hole transporting material on a back surface of the photoconductive layer is less than 1/6 or more than 1/3.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrophotographic photoconductor including:

- a conductive substrate; and
- a single-layer-type photoconductive layer that is provided on the conductive substrate and contains a binder resin, a charge generating material, a hole transporting material, and an electron transporting material, in which
- a volume resistivity of the photoconductive layer after wear is $5.0\times10^{10}$ Ω·cm or more and $2.0\times10^{11}$ Ω·cm or less when a ratio of a thickness of the photoconductive layer after wear to a thickness of the photoconductive layer before wear (the thickness of the photoconductive layer after wear/the thickness of the photoconductive layer before wear) is 0.8.

BRIEF DESCRIPTION OF DRAWINGS

Exemplary embodiment(s) of the present invention will be described in detail based on the following figures, wherein.

DETAILED DESCRIPTION

Figure 1:
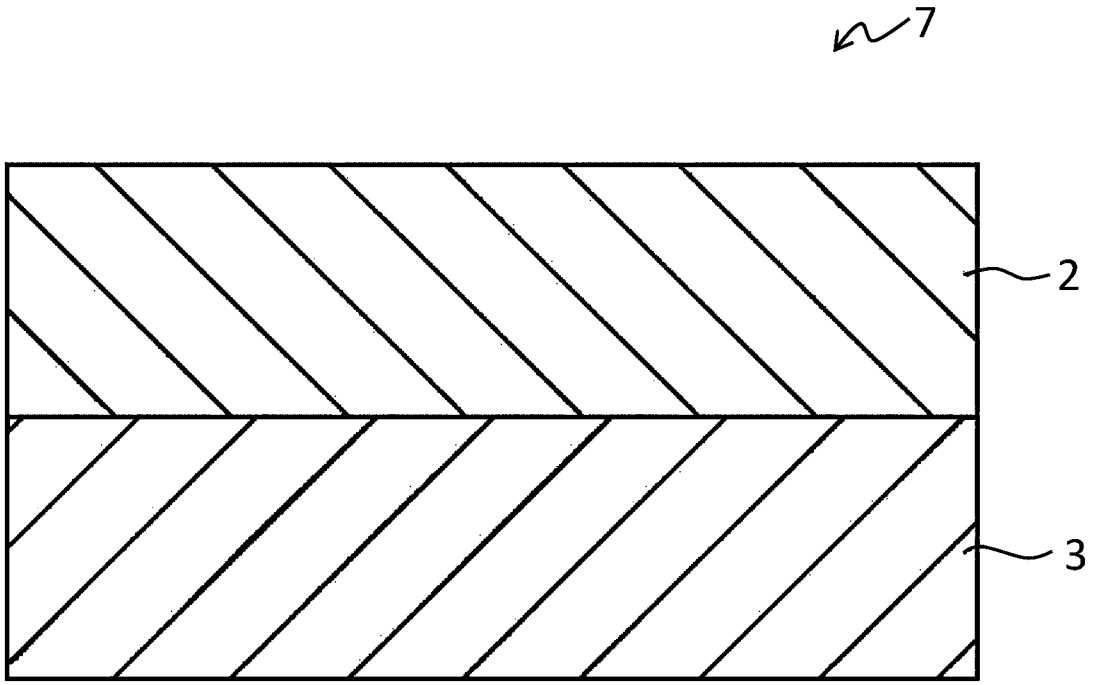
FIG. 1 is a schematic partial cross-sectional view illustrating an example of a layer configuration of an electrophotographic photoconductor according to an exemplary embodiment.

Hereinafter, an exemplary embodiment of the present invention will be described in detail.

In the numerical ranges described in stages in the present description, an upper limit or a lower limit described in one numerical range may be replaced with an upper limit or a lower limit of the numerical range described in other stages. Further, in the numerical ranges described in the present description, the upper limit or the lower limit of the numerical range may be replaced with values shown in Examples.

In the present description, the term "step" indicates not only an independent step, and even when a step cannot be clearly distinguished from other steps, this step is included in the term "step" as long as the intended purpose of the step is achieved.

Each component may contain plural kinds of corresponding substances.

In a case of referring to an amount of each component, when there are plural kinds of substances corresponding to each component, unless otherwise specified, it refers to a total amount of the plurality of substances.

An electrophotographic photoconductor having a single-layer-type photoconductive layer is also referred to as a "single-layer-type photoconductor". A single-layer-type photoconductive layer is a photoconductive layer having a hole transporting property and an electron transporting property as well as a charge generating ability.

Electrophotographic Photoconductor

First Exemplary Embodiment

An electrophotographic photoconductor according to a first exemplary embodiment includes a conductive substrate, and a single-layer-type photoconductive layer that is provided on the conductive substrate and contains a binder resin, a charge generating material, a hole transporting material, and an electron transporting material.

A volume resistivity of the photoconductive layer after wear is $5.0\times10^{10}$ Ω·cm or more and $2.0\times10^{11}$ Ω·cm or less when a ratio of a thickness of the photoconductive layer after wear to a thickness of the photoconductive layer before wear (the thickness of the photoconductive layer after wear/the thickness of the photoconductive layer before wear) is 0.8.

With the above configuration, the electrophotographic photoconductor according to the first exemplary embodiment prevents occurrence of black spots while having a high light sensitivity. The reasons are presumed as follows.

Firstly, when a single-layer-type photoconductor is used to form images repeatedly, black spots due to cracking of the photoconductive layer may occur. In the single-layer-type photoconductor, the initial single-layer-type photoconductive layer before wear has a desired volume resistivity and film strength, and thus the occurrence of the black spots after wear may be prevented.

However, as black spots due to reasons other than the cracking of the single-layer-type photoconductive layer, black spots may occur due to current leakage (hereinafter, also referred to as leak) caused by an increase in total amount of charges flowing through the single-layer-type photoconductive layer after the images are formed repeatedly.

In contrast, after wear is progressed, that is, after the images are formed repeatedly by increasing the volume resistivity of the photoconductive layer after wear to $5.0\times10^{10}$ Ω·cm or more when the ratio of the thickness of the photoconductive layer after wear to the thickness of the photoconductive layer before wear (the thickness of the photoconductive layer after wear/the thickness of the photoconductive layer before wear) is 0.8, the occurrence of the black spots due to the leak caused by the increase in total amount of charges flowing through the single-layer-type photoconductive layer may be prevented.

On the other hand, when the volume resistivity of the photoconductive layer after wear is excessively increased, the light sensitivity is lowered, and thus the volume resistivity of the photoconductive layer after wear is reduced to $2.0\times10^{11}$ Ω·cm or less.

From the above, it is presumed that with the above configuration, the electrophotographic photoconductor according to the first exemplary embodiment prevents the occurrence of the black spots while having a high light sensitivity.

Second Exemplary Embodiment

An electrophotographic photoconductor according to a second exemplary embodiment includes a conductive substrate, and a single-layer-type photoconductive layer that is provided on the conductive substrate and contains a binder resin, a charge generating material, a hole transporting material, and an electron transporting material.

A ratio of an amount of the hole transporting material on a front surface of the photoconductive layer to an amount of the hole transporting material on a back surface of the photoconductive layer (the amount of the hole transporting material on the front surface of the photoconductive layer/the amount of the hole transporting material on the back surface of the photoconductive layer) is 1/6 or more and 1/3 or less.

With the above configuration, the electrophotographic photoconductor according to the second exemplary embodiment prevents occurrence of black spots while having a high light sensitivity. The reasons are as follows.

As described above, when a single-layer-type photoconductor is used, as black spots due to reasons other than cracking of the single-layer-type photoconductive layer, black spots may occur due to current leakage (hereinafter, also referred to as leak) caused by an increase in total amount of charges flowing through the single-layer-type photoconductive layer after images are formed repeatedly.

In contrast, the ratio of the amount of the hole transporting material on the front surface of the photoconductive layer to the amount of the hole transporting material on the back surface of the photoconductive layer is set to 1/3 or less, and the hole transporting material is unevenly distributed on a conductive substrate side in the photoconductive layer. As a result, the volume resistivity of the photoconductive layer after wear is increased, and the occurrence of the black spots due to the leak caused by the increase in total amount of charges flowing through the single-layer-type photoconductive layer may be prevented after the images are formed repeatedly.

On the other hand, the ratio of the amount of the hole transporting material on the front surface of the photoconductive layer to the amount of the hole transporting material on the back surface of the photoconductive layer is set to 1/6 or more, and the hole transporting material is prevented from being excessively unevenly distributed on the conductive substrate side in the photoconductive layer. As a result, the volume resistivity of the photoconductive layer after wear does not become excessively high, and a decrease in light sensitivity is prevented.

From the above, it is presumed that with the above configuration, the electrophotographic photoconductor according to the second exemplary embodiment prevents the occurrence of the black spots while having a high light sensitivity.

Exemplary Embodiment

Hereinafter, an electrophotographic photoconductor corresponding to both the electrophotographic photoconductors according to the first and second exemplary embodiments (hereinafter, also referred to as "the electrophotographic photoconductor according to the exemplary embodiment") will be described in detail. However, an example of the electrophotographic photoconductor of the present invention may be any electrophotographic photoconductor corresponding to one of the electrophotographic photoconductors according to the first and second exemplary embodiments.

Hereinafter, the electrophotographic photoconductor according to the exemplary embodiment will be described in detail.

In the electrophotographic photoconductor according to the exemplary embodiment, the volume resistivity of the photoconductive layer after wear is $5.0\times10^{10}$ Ω·cm or more and $2.0\times10^{11}$ Ω·cm or less when the ratio of the thickness of the photoconductive layer after wear to the thickness of the photoconductive layer before wear (the thickness of the photoconductive layer after wear/the thickness of the photoconductive layer before wear) is 0.8, and is preferably $6.5\times10^{10}$ Ω·cm or more and $1.5\times10^{11}$ Ω·cm or less, and more preferably $8.0\times10^{10}$ Ω·cm or more and $1.0\times10^{11}$ Ω·cm or less from the viewpoints of the high light sensitivity and the prevention of the occurrence of the black spots.

A ratio of the volume resistivity of the photoconductive layer after wear to a volume resistivity of the photoconductive layer before wear (the volume resistivity of the photoconductive layer after wear/the volume resistivity of the photoconductive layer before wear) is preferably 1/100 or more and 7/100 or less, more preferably 1/50 or more and 3/50 or less, and still more preferably 3/100 or more and 2/50 or less from the viewpoints of the high light sensitivity and the prevention of the occurrence of the black spots.

The volume resistivity of the photoconductive layer before wear and the volume resistivity of the photoconductive layer after wear are controlled by, for example, the following:

1) a temperature of a photoconductive layer-forming coating liquid (preferably, the temperature is lowered);
2) a temperature of the conductive substrate during coating of the coating liquid (preferably, the temperature is lowered);
3) a drying temperature (preferably, the temperature is lowered);
4) types of the hole transporting material (preferably, a hole transporting material having a benzidine skeleton is used); and
5) types of the electron transporting material (preferably, an electron transporting material having a diphenoquinone skeleton is used).

The volume resistivity of the photoconductive layer before wear and the volume resistivity of the photoconductive layer after wear are measured as follows.

A photoconductive layer sample is collected from a photoconductor to be measured as follows. The photoconductor is cut into a cylindrical shape having a length of 6 cm, and is further cut to half so as to become a semicircle. Ends of a photoconductor section are sandwiched by a vise, and a force is applied such that a curvature of the semicircle becomes large to raise the photoconductive layer from the substrate, and the photoconductive layer is collected.

Next, with respect to the collected section sample of the photoconductive layer, an Au electrode is formed on a front surface side of the photoconductive layer with an electrode area of 1 $cm^2$, and an Al electrode is formed on an entire surface of a film on a back surface side of the photoconductive layer by sputtering. Next, under an environment of a temperature of 30° C. and a relative humidity of 80%, a voltage adjusted to an electric field of 20 V/μm (applied voltage/measurement sample thickness) is applied for 30 seconds under dark conditions using a frequency response analyzer (1260 type, manufactured by Solartron), and then a flowing current value (A) thereof is measured.

Then, the volume resistivity is calculated by using the obtained current value according to the following equation. The obtained volume resistivity is defined as the volume resistivity of the photoconductive layer before wear.

$$\text{Volume resistivity } (\Omega\cdot m)=(10^{-4}\ (m^2)\times\text{applied voltage } (V))/(\text{current value } (A)\times\text{measurement sample thickness } (m)) \quad \text{Equation}$$

Meanwhile, the collected section sample of the photoconductive layer is fixed to a rotary stage of a friction and wear tester (FPR2100, manufactured by Rhesca Co., Ltd.) using a tape such that the front surface side of the photoconductive layer faces up. A lapping film sheet (abrasive aluminum oxide, particle size: 9 μm) is attached to an indenter portion.

At a rotation speed of 100 rpm, the photoconductive layer is worn from the front surface side. A wear amount is adjusted while checking a film thickness after wear by a step meter (Surfcom S1500, manufactured by Tokyo Seimitsu Co., Ltd.)

The volume resistivity is calculated for the worn measurement sample in the same manner as described above. The obtained volume resistivity is defined as the volume resistivity of the photoconductive layer after wear.

In the electrophotographic photoconductor according to the exemplary embodiment, the ratio of the amount of the hole transporting material on the front surface of the photoconductive layer to the amount of the hole transporting material on the back surface of the photoconductive layer (the amount of the hole transporting material on the front surface of the photoconductive layer/the amount of the hole transporting material on the back surface of the photoconductive layer) is 1/6 or more and 1/3 or less, and is preferably 1.1/6 or more and 3/10 or less, and more preferably 1/5 or more and 1/4 or less from the viewpoints of the high light sensitivity and the prevention of the occurrence of the black spots.

The ratio of the amounts of the hole transporting material is controlled by the same method as the above volume resistivity of the photoconductive layer before wear and the above volume resistivity of the photoconductive layer after wear.

Here, the "front surface of the photoconductive layer" refers to a surface of two surfaces facing each other in a thickness direction of the photoconductive layer, which is opposite to the conductive substrate. Meanwhile, the "back surface of the photoconductive layer" refers to a surface of the surfaces facing each other in the thickness direction of the photoconductive layer, which is on the conductive substrate side.

The ratio of the amounts of the hole transporting material is measured as follows.

Firstly, a photoconductive layer sample is collected from the photoconductor to be measured as follows. A 0.5 cm×0.5 cm square cut is made in the film using a single-edged knife in a manner of reaching the substrate, and a film of a square portion of 0.5 cm×0.5 cm naturally peels off from the substrate. The peeled piece of the photoconductive layer is used as a sample.

Next, Fourier transform infrared spectroscopy is performed, by an attenuated total reflection method (that is, ATR method), on the front surface of the photoconductive layer in the obtained sample. Specifically, an infrared spectroscopic analyzer (NICOLET 6700FT-IR, manufactured by Thermo Fisher Scientific, Inc.) is used as a measurement device, and measurement is performed under conditions of measurement area: 650 $cm^{-1}$ to 4000 $cm^{-1}$, resolution: 4

$cm^{-1}$, the number of integrations: 32 times, refraction medium: ZnSe, and measurement depth: 2 μm.

Based on an infrared absorption spectrum on the front surface of the photoconductive layer in infrared absorption spectra obtained by the above measurement, an area of an absorption peak derived from the hole transporting material (for example, an absorption peak of the hole transporting material appearing at 680 $cm^{-1}$ or more and 720 $cm^{-1}$ or less when the hole transporting material is the hole transporting material having the benzidine skeleton), and an area of an absorption peak derived from the binder resin (for example, an absorption peak derived from a C═O bond of the binder resin appearing at 1675 $cm^{-1}$ or more and 1860 $cm^{-1}$ or less when the binder resin is a polycarbonate resin) are obtained, and the amount of the hole transporting material on the front surface of the photoconductive layer is obtained as (the above peak area of the hole transporting material/the above peak area of the resin)=(the amount of the hole transporting material).

On the other hand, Fourier transform infrared spectroscopy is performed, by the attenuated total reflection method in the same manner as described above, on the back surface of the photoconductive layer in the obtained sample, and the amount of the hole transporting material on the back surface of the photoconductive layer is obtained.

Next, the electrophotographic photoconductor according to the exemplary embodiment will be described in detail with reference to the drawings.

FIG. 1 schematically illustrates a cross section of a part of an electrophotographic photoconductor 7 according to the exemplary embodiment.

The electrophotographic photoconductor 7 illustrated in FIG. 1 includes, for example, a conductive substrate 3 and a single-layer-type photoconductive layer 2, as an outermost layer, provided on the conductive substrate 3.

Other layers may be provided as necessary. Examples of the other layers include an undercoat layer provided between the conductive substrate 3 and the single-layer-type photoconductive layer 2, and a protective layer provided on the single-layer-type photoconductive layer 2.

Hereinafter, each layer of the electrophotographic photoconductor according to the exemplary embodiment will be described in detail. In the following description, reference numerals will be omitted.

Conductive Substrate

Examples of the conductive substrate include a metal plate, a metal drum, and a metal belt containing a metal (aluminum, copper, zinc, chromium, nickel, molybdenum, vanadium, indium, gold, platinum, etc.) or an alloy (stainless steel, etc.). Further, examples of the conductive substrate include paper, a resin film, and a belt coated, deposited, or laminated with a conductive compound (a conductive polymer, indium oxide, etc.), a metal (aluminum, palladium, gold, etc.), or an alloy. Here, the expression "conductive" means that the volume resistivity is less than $10^{13}$ Ω·cm.

When the electrophotographic photoconductor is used in a laser printer, the surface of the conductive substrate is preferably roughened to a center line average roughness Ra of 0.04 μm or more and 0.5 μm or less for the purpose of preventing interference fringes generated when irradiating with a laser beam. When a non-interfering light is used as a light source, the roughening for preventing the interference fringes is not particularly necessary, but the roughening prevents occurrence of defects due to unevenness of the surface of the conductive substrate, and thus is suitable for extending a lifetime of the conductive substrate.

Examples of a roughening method include wet honing performed by suspending an abrasive in water and spraying the obtained suspension onto a support, centerless grinding in which a conductive substrate is pressed against a rotating grinding stone to perform continuous grinding, and an anodizing treatment.

Examples of the roughening method also include a method of roughening the surface of the conductive substrate by dispersing a conductive or semiconductive powder in a resin, then forming a layer of the resin on the surface of the conductive substrate, and dispersing the particles in the layer, without roughening the surface of the conductive substrate itself.

In a roughening treatment by anodizing, by anodizing, in an electrolyte solution, a conductive substrate made of a metal (for example, made of aluminum) as an anode, a porous anodic oxide film is formed on the surface of the conductive substrate. Examples of the electrolyte solution include a sulfuric acid solution and an oxalic acid solution. However, the porous anodic oxide film formed by anodizing is chemically active in a state as it is, is easily contaminated, and has a large resistance variation depending on an environment. Therefore, it is preferable to perform a pore-sealing treatment in which the porous anodic oxide film is subjected to a hydration reaction in pressurized water vapor or boiling water (a salt of a metal such as nickel may be added), fine pores of the porous anodic oxide film are sealed by volume expansion due to the hydration reaction, and the porous anodic oxide film is changed to a more stable hydrated oxide.

A film thickness of the anodic oxide film is preferably 0.3 μm or more and 15 μm or less, for example. When the film thickness is within the above range, a barrier property against injection tends to be exhibited, and an increase in residual potentials due to repeated use tends to be prevented.

The conductive substrate may be subjected to a treatment with an acidic treatment solution or a boehmite treatment.

The treatment with the acidic treatment solution is performed, for example, as follows. Firstly, an acidic treatment solution containing phosphoric acid, chromic acid, and hydrofluoric acid is prepared. A blending ratio of the phosphoric acid, the chromic acid, and the hydrofluoric acid in the acidic treatment solution may be: for example, the phosphoric acid in a range of 10 mass % or more and 11 mass % or less, the chromic acid in a range of 3 mass % or more and 5 mass % or less, and the hydrofluoric acid in a range of 0.5 mass % or more and 2 mass % or less, and a concentration of all the acids as a whole may be in a range of 13.5 mass % or more and 18 mass % or less. A treatment temperature is preferably 42° C. or higher and 48° C. or lower, for example. A film thickness of a coating film formed by the treatment with the acidic treatment solution is preferably 0.3 μm or more and 15 μm or less.

The boehmite treatment is performed, for example, by immersing the conductive substrate in pure water at 90° C. or higher and 100° C. or lower for 5 minutes to 60 minutes, or bringing the conductive substrate into contact with heated water vapor at 90° C. or higher and 120° C. or lower for 5 minutes to 60 minutes. A film thickness of a coating film formed by the boehmite treatment is preferably 0.1 μm or more and 5 μm or less. The conductive substrate subjected to the boehmite treatment may be further anodized with an electrolyte solution having a low solubility of a coating film, such as a solution of an adipic acid, a boric acid, a borate, a phosphate, a phthalate, a maleate, a benzoate, a tartrate, or a citrate.

Single-Layer-Type Photoconductive Layer

The single-layer-type photoconductive layer contains a binder resin, a charge generating material, a hole transporting material, and an electron transporting material. The single-layer-type photoconductive layer may contain other additives as necessary. Hereinafter, each component included in the single-layer-type photoconductive layer will be described in detail.

Binder Resin

The binder resin is not particularly limited, and examples thereof include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinylcarbazole, and polysilane.

These binder resins may be used alone or in combination of two or more thereof.

Among the binder resins, a polycarbonate resin and a polyarylate resin are preferred.

Further, from the viewpoint of a film-forming property of the photoconductive layer, at least one of a polycarbonate resin having a viscosity average molecular weight of 30,000 or more and 80,000 or less and a polyarylate resin having a viscosity average molecular weight of 30,000 or more and 80,000 or less may be used.

The viscosity average molecular weight of the polycarbonate resin or the polyarylate resin is measured by, for example, the following method. 1 g of the resin is dissolved in 100 $cm^3$ of methylene chloride, then a specific viscosity ηsp thereof is measured by an Ubbelohde viscometer under a measurement environment of 25° C., thereafter a limiting viscosity [η] ($cm^3/g$) is obtained based on a relational expression of $\eta sp/c=[\eta]+0.45\,[\eta]^2c$ (where c is a concentration ($g/cm^3$)), and a viscosity average molecular weight My is obtained based on an equation given by H. Schnel and a relational expression of $[\eta]=1.23\times10^{-4}\,Mv^{0.83}$.

The binder resin is particularly preferably a polycarbonate resin containing at least one of a structural unit represented by the following general formula (PCA) and a structural unit represented by the following general formula (PCB).

(PCA)

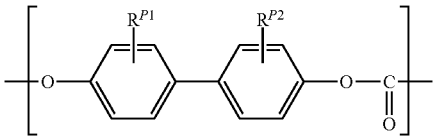

(PCB)

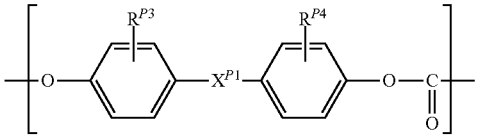

In the above general formulas (PCA) and (PCB), $R^{P1}$, $R^{P2}$, $R^{P3}$, and $R^{P4}$ each independently represent a hydrogen atom, a halogen atom, an alkyl group having 1 or more and 6 or less carbon atoms, a cycloalkyl group having 5 or more and 7 or less carbon atoms, or an aryl group having 6 or more and 12 or less carbon atoms. $X^{P1}$ represents a phenylene group, a biphenylene group, a naphthylene group, an alkylene group, or a cycloalkylene group.

In the general formulas (PCA) and (PCB), examples of the alkyl group represented by $R^{P1}$, $R^{P2}$, $R^{P3}$, and $R^{P4}$ include a linear or branched alkyl group having 1 or more and 6 or less carbon atoms (preferably 1 or more and 3 or less carbon atoms).

Specific examples of the linear alkyl group include a methyl group, an ethyl group, an n-propyl group, an n-butyl group, an n-pentyl group, and an n-hexyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, and a tert-hexyl group.

Among these, the alkyl group is preferably a lower alkyl group such as a methyl group or an ethyl group.

In the general formulas (PCA) and (PCB), examples of the cycloalkyl group represented by $R^{P1}$, $R^{P2}$, $R^{P3}$, and $R^{P4}$ include cyclopentyl, cyclohexyl, and cycloheptyl.

In the general formulas (PCA) and (PCB), examples of the aryl group represented by $R^{P1}$, $R^{P2}$, $R^{P3}$, and $R^{P4}$ include a phenyl group, a naphthyl group, and a biphenylyl group.

In the general formulas (PCA) and (PCB), examples of the alkylene group represented by $X^{P1}$ include a linear or branched alkylene group having 1 or more and 12 or less carbon atoms (preferably 1 or more and 6 or less carbon atoms, and more preferably 1 or more and 3 or less carbon atoms).

Specific examples of the linear alkylene group include a methylene group, an ethylene group, an n-propylene group, an n-butylene group, an n-pentylene group, an n-hexylene group, an n-heptylene group, an n-octylene group, an n-nonylene group, an n-decylene group, an n-undecylene group, and an n-dodecylene group.

Specific examples of the branched alkylene group include an isopropylene group, an isobutylene group, a sec-butylene group, a tert-butylene group, an isopentylene group, a neopentylene group, a tert-pentylene group, an isohexylene group, a sec-hexylene group, a tert-hexylene group, an isoheptylene group, a sec-heptylene group, a tert-heptylene group, an isooctylene group, a sec-octylene group, a tert-octylene group, an isononylene group, a sec-nonylene group, a tert-nonylene group, an isodecylene group, a sec-decylene group, a tert-decylene group, an isoundecylene group, a sec-undecylene group, a tert-undecylene group, a neoundecylene group, an isododecylene group, a sec-dodecylene group, a tert-dodecylene group, and a neododecylene group.

Among these, the alkylene group is preferably a lower alkyl group such as a methylene group, an ethylene group, or a butylene group.

In the general formulas (PCA) and (PCB), examples of the cycloalkylene group represented by $X^{P1}$ include a cycloalkylene group having 3 or more and 12 or less carbon atoms (preferably 3 or more and 10 or less carbon atoms, and more preferably 5 or more and 8 or less carbon atoms).

Specific examples of the cycloalkylene group include a cyclopropylene group, a cyclopentylene group, a cyclohexylene group, a cyclooctylene group, and a cyclododecene group.

Among these, the cycloalkylene group is preferably a cyclohexylene group.

In the general formulas (PCA) and (PCB), each of the above substituents represented by $R^{P1}$, $R^{P2}$, $R^{P3}$, $R^{P4}$, and $X^{P1}$ further includes a group having a substituent. Examples of the substituent include a halogen atom (for example, a fluorine atom and a chlorine atom), an alkyl group (for example, an alkyl group having 1 or more and 6 or less carbon atoms), a cycloalkyl group (for example, a cycloalkyl group having 5 or more and 7 or less carbon atoms), an alkoxy group (for example, an alkoxy group having 1 or more and 4 or less carbon atoms), and an aryl group (for example, a phenyl group, a naphthyl group, and a biphenylyl group).

In the general formula (PCA), $R^{P1}$ and $R^{P2}$ each independently preferably represent a hydrogen atom or an alkyl group having 1 or more and 6 or less carbon atoms, and more preferably, $R^{P1}$ and $R^{P2}$ each represent a hydrogen atom.

In the general formula (PCB), $R^{P3}$ and $R^{P4}$ each independently preferably represent a hydrogen atom or an alkyl group having 1 or more and 6 or less carbon atoms, and preferably, represents an alkylene group or a cycloalkylene group.

Specific examples of the structural units represented by the general formula (PCA) and the structural unit represented by the general formula (PCB) include, but are not limited to, the following.

(PCA-1)

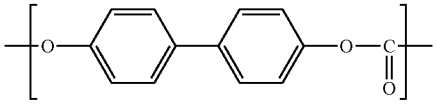

(PCB-1)

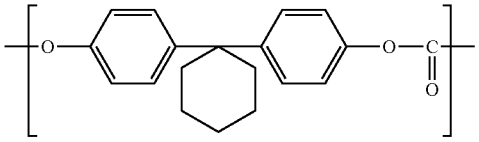

(PCB-2)

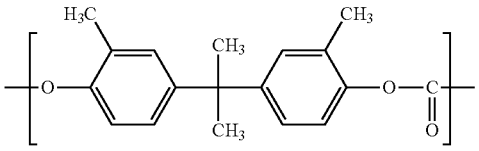

(PCB-3)

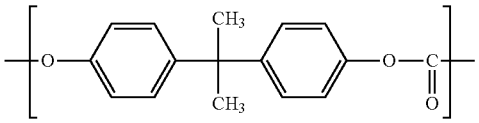

Further, the binder resin is more preferably a polycarbonate resin containing both the structural unit represented by general formula (PCA) and the structural unit represented by the general formula (PCB).

Specific examples of the polycarbonate resin containing both the structural unit represented by the general formula (PCA) and the structural unit represented by the general formula (PCB) include, but are not limited to, the following. In the exemplified compounds, "pm" and "pn" represent a copolymerization ratio.

(PC-1)

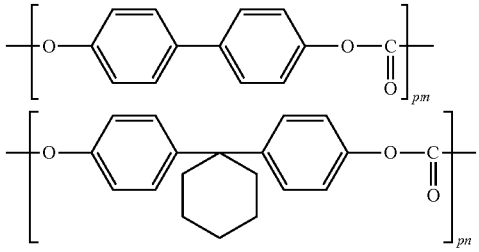

(PC-2)

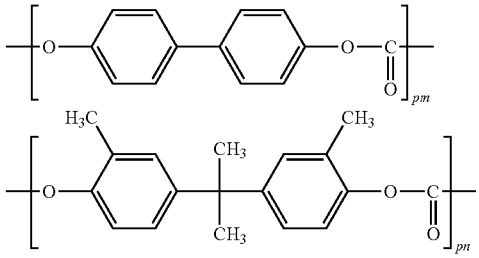

(PC-3)

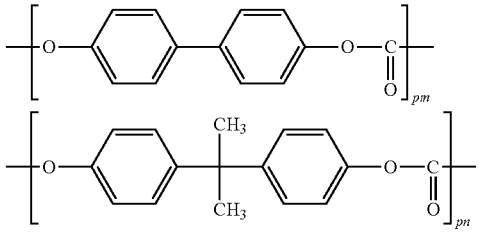

Here, in the polycarbonate resin containing both the structural unit represented by the general formula (PCA) and the structural unit represented by the general formula (PCB), a content ratio (copolymerization ratio) of the structural unit represented by the general formula (PCA) may be in a range of 5 mol % or more and 95 mol % or less, and, from the viewpoint of enhancing wear resistance of the photoconductive layer (charge transport layer), is preferably in a range of 5 mol % or more and 50 mol % or less, and still more preferably in a range of 15 mol % or more and 30 mol % or less with respect to all structural units constituting the polycarbonate resin.

Specifically, in the above exemplified compounds of the polycarbonate resin, pm and pn represent the copolymerization ratio (molar ratio), and examples thereof include a range of pm:pn=95:5 to 5:95, a range of 50:50 to 5:95, and still more preferably a range of 15:85 to 30:70.

When the polycarbonate resin containing at least one of the structural unit represented by the general formula (PCA) and the structural unit represented by the general formula (PCB) is used in combination with another binder resin, a content of the another binder resin may be 10 mass % or less (preferably 5 mass % or less) with respect to the total binder resin.

A content of the binder resin with respect to the total solid content of the photoconductive layer may be 35 mass % or more and 60 mass % or less, and preferably 40 mass % or more and 55 mass % or less.

Charge Generating Material

Examples of the charge generating material include an azo pigment such as bisazo and trisazo, a condensed-ring aromatic pigment such as dibromoanthanthrone, a perylene pigment, a pyrrolopyrrole pigment, a phthalocyanine pigment, zinc oxide, and trigonal selenium.

Among these, in order to cope with laser exposure in a near-infrared region, it is preferable to use a metal phthalocyanine pigment or a metal-free phthalocyanine pigment as the charge generating material. Specifically, the charge generating material is, for example, more preferably hydroxygallium phthalocyanine disclosed in JP-A-H05-263007, JP-A-H05-279591, etc., chlorogallium phthalocyanine disclosed in JP-A-H05-98181, etc., dichlorotin phthalocyanine disclosed in JP-A-H05-140472, JP-A-H05-140473, etc., and titanyl phthalocyanine disclosed in JP-A-H04-189873, etc.

Meanwhile, in order to cope with laser exposure in a near-ultraviolet region, the charge generating material is preferably a condensed-ring aromatic pigment such as dibromoanthanthrone, a thioindigo pigment, a porphyrazine compound, zinc oxide, trigonal selenium, and a bisazo pigment disclosed in JP-A-2004-78147 and JP-A-2005-181992.

That is, the charge generating material is, for example, preferably an inorganic pigment when a light source having an exposure wavelength of 380 nm or more and 500 nm or less is used, and preferably a metal phthalocyanine pigment and a metal-free phthalocyanine pigment when a light source having an exposure wavelength of 700 nm or more and 800 nm or less is used.

Here, the charge generating material is preferably at least one selected from a hydroxygallium phthalocyanine pigment and a chlorogallium phthalocyanine pigment, and more preferably a hydroxygallium phthalocyanine pigment, from the viewpoint of achieving a high sensitivity of the single-layer-type photoconductor.

The hydroxygallium phthalocyanine pigment is not particularly limited, and a V-type hydroxygallium phthalocyanine pigment may be used.

In particular, the hydroxygallium phthalocyanine pigment is, for example, desirably a hydroxygallium phthalocyanine pigment having a maximum peak wavelength in a range of 810 nm or more and 839 nm or less in a spectral absorption spectrum in a wavelength region of 600 nm or more and 900 nm or less from the viewpoint of obtaining more excellent dispersibility. When the hydroxygallium phthalocyanine pigment is used as a material of the electrophotographic photoconductor, excellent dispersibility, sufficient sensitivity, chargeability, and dark attenuation characteristics may be easily obtained.

Further, the above hydroxygallium phthalocyanine pigment having a maximum peak wavelength in a range of 810 nm or more and 839 nm or less desirably has an average particle diameter in a specific range and a BET specific surface area in a specific range. Specifically, the average particle diameter is desirably 0.20 μm or less, and more desirably 0.01 μm or more and 0.15 μm or less, and the BET specific surface area is desirably 45 $m^2/g$ or more, more desirably 50 $m^2/g$ or more, and particularly desirably 55 $m^2/g$ or more and 120 $m^2/g$ or less. The average particle diameter is a value measured by a laser diffraction and scattering particle size distribution measurement device (LA-700, manufactured by Horiba, Ltd.) in terms of a volume average particle diameter (d50 average particle diameter). Further, the BET specific surface area is a value measured by a nitrogen substitution method using a BET type specific surface area measuring apparatus (FlowSorb II 2300, manufactured by Shimadzu Corporation).

Here, when the average particle diameter is larger than 0.20 μm or the specific surface area value is less than 45 $m^2/g$, pigment particles tend to be coarsened or aggregates of the pigment particles tend to be formed, and defects tend to occur in characteristics such as dispersibility, sensitivity, chargeability, and dark attenuation characteristics, which may lead to image quality defects.

A maximum particle diameter (maximum value of primary particle diameter) of the hydroxygallium phthalocyanine pigment is desirably 1.2 μm or less, more desirably 1.0 μm or less, and still more desirably 0.3 μm or less. When the maximum particle diameter exceeds the above range, black spots are likely to occur.

The hydroxygallium phthalocyanine pigment desirably has an average particle diameter of 0.2 μm or less, a maximum particle diameter of 1.2 μm or less, and a specific surface area value of 45 $m^2/g$ or more, from the viewpoint of preventing density unevenness caused by exposure of the photoconductor to a fluorescent lamp or the like.

The hydroxygallium phthalocyanine pigment is desirably a V-type one having diffraction peaks at Bragg angles (2θ±0.2°) of at least 7.3°, 16.0°, 24.9°, and 28.0° in an X-ray diffraction spectrum using CuKα characteristic X-rays.

Meanwhile, the chlorogallium phthalocyanine pigment is, for example, desirably one having diffraction peaks at Bragg angles (2θ±0.2°) of 7.4°, 16.6°, 25.5°, and 28.3°, at which excellent sensitivity is obtained for an electrophotographic photoconductor material.

A maximum peak wavelength of a suitable spectral absorption spectrum, an average particle diameter, a maximum particle diameter, and a specific surface area value of the chlorogallium phthalocyanine pigment are the same as those of the hydroxygallium phthalocyanine pigment.

A content of the charge generating material with respect to the total solid content of the photoconductive layer may be 1 mass % or more and 5 mass % or less, and preferably 1.2 mass % or more and 4.5 mass % or less.

Hole Transporting Material

The hole transporting material is not particularly limited, and examples thereof include: an oxadiazole derivative such as 2,5-bis(p-diethylaminophenyl)-1,3,4-oxadiazole; a pyrazoline derivative such as 1,3,5-triphenyl-pyrazoline and 1-[pyridyl-(2)]-3-(p-diethylaminostyryl)-5-(p-diethylaminostyryl) pyrazoline; an aromatic tertiary amino compound such as triphenylamine, N,N'-bis(3,4-dimethylphenyl)biphenyl-4-amine, tri(p-methylphenyl)aminyl-4-amine, and dibenzylaniline; an aromatic tertiary diamino compound such as N,N'-bis(3-methylphenyl)-N,N'-diphenylbenzidine; a 1,2,4-triazine derivative such as 3-(4'-dimethylaminophenyl)-5,6-di-(4'-methoxyphenyl)-1,2,4-triazine; a hydrazone derivative such as 4-diethylaminobenzaldehyde-1,1-diphenylhydrazone; a quinoxazoline derivative such as 2-phenyl-4-styryl-quinoxazoline; a benzofuran derivative such as 6-hydroxy-2,3-di(p-methoxyphenyl)benzofuran; an α-stilbene derivative such as p-(2,2-diphenylvinyl)-N,N-diphenylaniline; an enamine derivative; a carbazole derivative such as N-ethylcarbazole; a poly-N-vinylcarbazole and a derivative thereof; and a polymer having a group in the main chain or the side chain and composed of the above compounds. These hole transporting materials may be used alone or in combination of two or more thereof.

Among these, examples of the hole transporting material suitably include a triarylamine-based hole transporting material represented by the following general formula (HT1), and a hole transporting material having a benzidine skeleton to be described later.

Triarylamine-Based Hole Transporting Material (HT1)

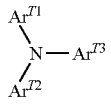

In the general formula (HT1), $Ar^{T1}$, $Ar^{T2}$, and $Ar^{T3}$ each independently represent an aryl group or $—C_6H_4—C(R^{T4})=C(R^{T5})(R^{T6})$. $R^{T4}$, $R^{T5}$, and $R^{T6}$ each independently represent a hydrogen atom, an alkyl group, or an aryl group. $R^{T5}$ and $R^{T6}$ may combine to form a hydrocarbon ring structure.

In the general formula (HT1), examples of the aryl group represented by $Ar^{T1}$, $Ar^{T2}$, and $Ar^{T3}$ include an aryl group having 6 or more and 15 or less (preferably 6 or more and 9 or less, and more preferably 6 or more and 8 or less) carbon atoms.

Specific examples of the aryl group include a phenyl group, a naphthyl group, and a fluorene group.

Among these, the aryl group is preferably a phenyl group.

In the general formula (HT1), examples of the alkyl group represented by $R^{T4}$, $R^{T5}$, and $R^{T6}$ are the same as examples of an alkyl group represented by $R^{C21}$, $R^{C22}$, and $R^{C23}$ in a general formula (HT1a) to be described later, and preferred ranges are also the same.

In the general formula (HT1), examples of the aryl group represented by $R^{T4}$, $R^{T5}$, and $R^{T6}$ are the same as the example of the aryl group represented by $Ar^{T1}$, $Ar^{T2}$, and $Ar^{T3}$, and preferred ranges are also the same.

In the general formula (HT1), each of the above substituents represented by $Ar^{T1}$, $Ar^{T2}$, $Ar^{T3}$, $R^{T4}$, $R^{T5}$, and $R^{T6}$ further include a group having a substituent. Examples of the substituent include a halogen atom, an alkyl group having 1 or more and 5 or less carbon atoms, an alkoxy group having 1 or more and 5 or less carbon atoms, and an aryl group having 6 or more and 10 or less carbon atoms. Further, examples of the substituent of each of the above substituents include a substituted amino group substituted with an alkyl group having 1 or more and 3 or less carbon atoms.

The triarylamine-based hole transporting material (HT1) may be used alone or in combination of two or more thereof.

Here, from the viewpoint of charge mobility, among the triarylamine-based hole transporting materials represented by the general formula (HT1), the triarylamine-based hole transporting material is particularly preferably one having "$—C_6H_4—C(R^{T4})=C(R^{T5})(R^{T6})$". Among these, the triarylamine-based hole transporting material is preferably one represented by a specific example (HT1-4) of a triarylamine-based hole transporting material (HT1) to be described later.

Benzidine-Based Hole Transporting Material

The hole transporting material having the benzidine skeleton is particularly preferred as the hole transporting material from the viewpoints of controlling the above volume resistivity of the photoconductive layer before wear and the above volume resistivity of the photoconductive layer after wear as well as the above amount ratio of the electron transporting material, and preventing the occurrence of the black spots while having a high light sensitivity. The hole transporting material having the benzidine skeleton is more preferably a benzidine-based hole transporting material represented by the following general formula (HT1a).

(HT1a)

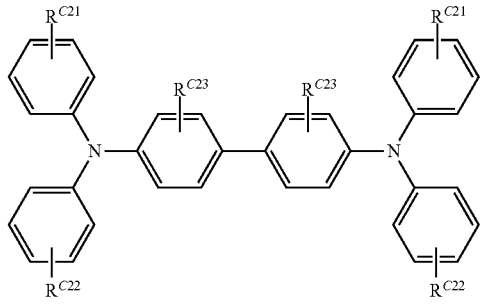

In the general formula (HT1a), $R^{C21}$, $R^{C22}$, and $R^{C23}$ each independently represent a hydrogen atom, a halogen atom, an alkyl group having 1 or more and 10 or less carbon atoms, an alkoxy group having 1 or more and 10 or less carbon atoms, or an aryl group having 6 or more and 10 or less carbon atoms.

In the general formula (HT1a), examples of the halogen atom represented by $R^{C21}$, $R^{C22}$, and $R^{C23}$ include a fluorine atom, a chlorine atom, a bromine atom, and an iodine atom. Among these, the halogen atom is preferably a fluorine atom or a chlorine atom, and more preferably a chlorine atom.

In the general formula (HT1a), examples of the alkyl group represented by $R^{C21}$, $R^{C22}$, and $R^{C23}$ include a linear or branched alkyl group having 1 or more and 10 or less (preferably 1 or more and 6 or less, and more preferably 1 or more and 4 or less) carbon atoms.

Specific examples of the linear alkyl group include a methyl group, an ethyl group, an n-propyl group, an n-butyl group, an n-pentyl group, an n-hexyl group, an n-heptyl group, an n-octyl group, an n-nonyl group, and an n-decyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

Among these, the alkyl group is preferably a lower alkyl group such as a methyl group, an ethyl group, or an isopropyl group.

In the general formula (HT1a), examples of the alkoxy group represented by $R^{C21}$, $R^{C22}$, and $R^{C23}$ include a linear or branched alkoxy group having 1 or more and 10 or less (preferably 1 or more and 6 or less, and more preferably 1 or more and 4 or less) carbon atoms.

Specific examples of the linear alkoxy group include a methoxy group, an ethoxy group, an n-propoxy group, an n-butoxy group, an n-pentylene group, an n-hexyloxy group, an n-heptylene group, an n-octygroup, an n-nonyloxy group, and an n-decyloxy group.

Specific examples of the branched alkoxy group include an isopropoxy group, an isobuthoxy group, a sec-butoxy group, a tert-butoxy group, an isopentyloxy group, a neopentyloxy group, a tert-pentylene group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, and a tert-decyloxy group.

Among these, the alkoxy group is preferably a methoxy group.

In the general formula (HT1a), examples of the aryl group represented by $R^{C21}$, $R^{C22}$, and $R^{C23}$ include an aryl group having 6 or more and 10 or less (preferably 6 or more and 9 or less, and more preferably 6 or more and 8 or less) carbon atoms.

Specific examples of the aryl group include a phenyl group and a naphthyl group.

Among these, the aryl group is preferably a phenyl group.

In the general formula (HT1a), each of the above substituents represented by $R^{C21}$, $R^{C22}$, and $R^{C23}$ further includes a group having a substituent. Examples of the substituent include the atoms and the groups as exemplified above (for example, a halogen atom, an alkyl group, an alkoxy group, and an aryl group).

The benzidine-based hole transporting material represented by the general formula (HT1a) may be used alone or in combination of two or more thereof.

Hereinafter, specific examples (HT1-1) to (HT1-10) of the triarylamine-based hole transporting material (HT1) and the benzidine-based hole transporting material (HT1a) are shown, but the triarylamine-based hole transporting material (HT1) and the benzidine-based hole transporting material (HT1a) are not limited thereto.

HT-1

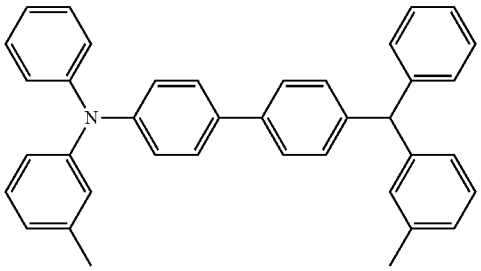

HT-2

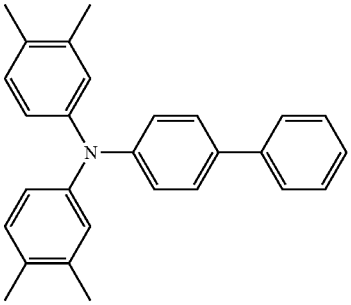

HT-3

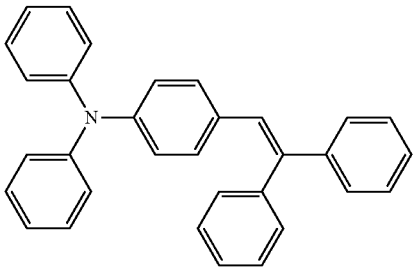

HT-4

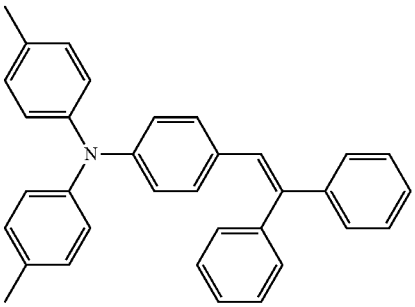

HT-5

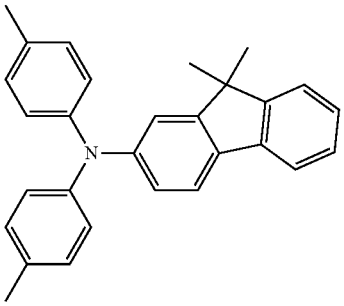

HT-6

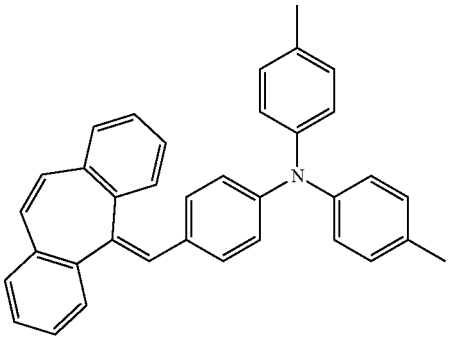

-continued

HT-7

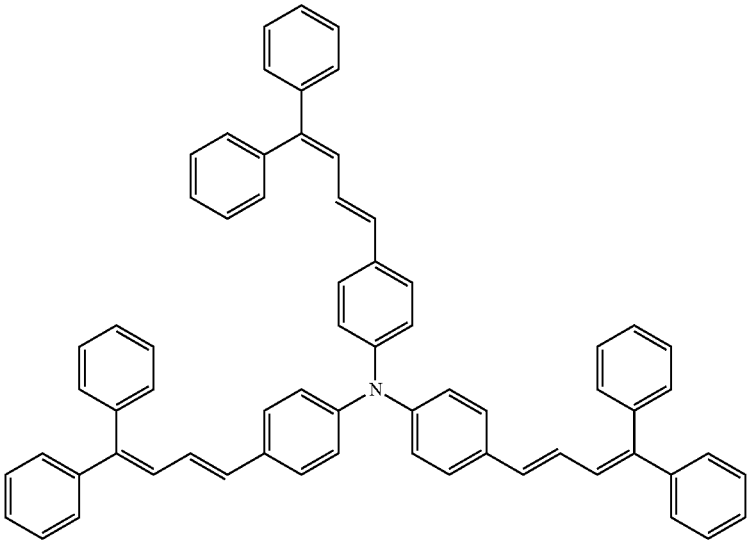

HT-8

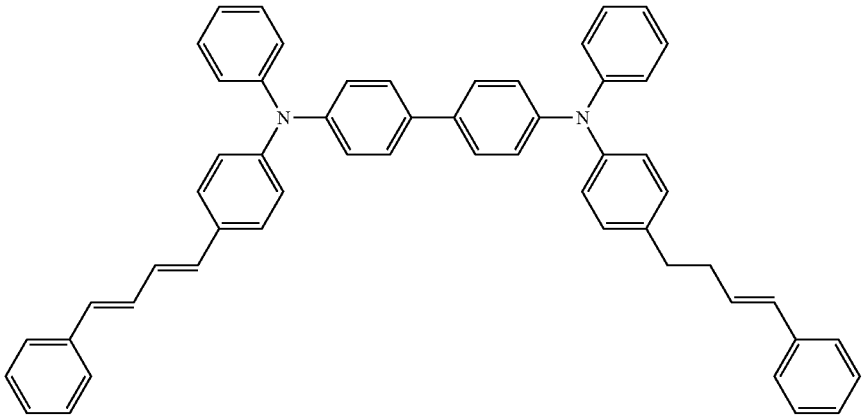

HT-9

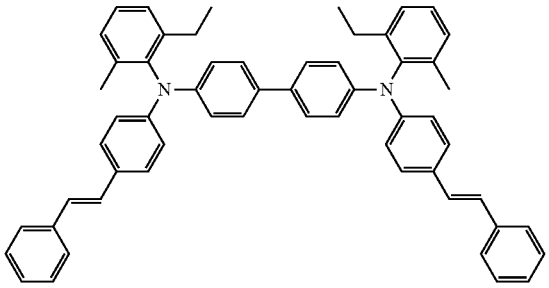

HT-10

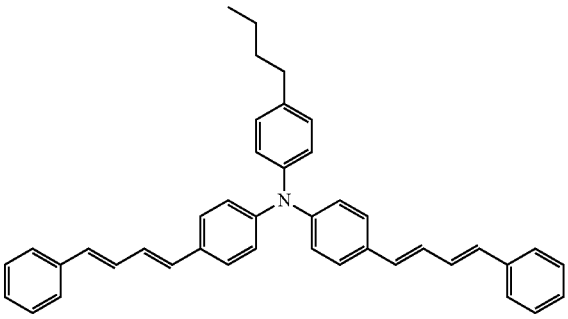

A content of the hole transporting material with respect to the total solid content of the photoconductive layer may be 20 mass % or more and 45 mass % or less, preferably 34 mass % or more and 44 mass % or less, more preferably 38 mass % or more and 44 mass % or less, and still more preferably 38 mass % or more and 42 mass % or less, from the viewpoints of the high light sensitivity and the prevention of the occurrence of the black spots.

Further, from the viewpoints of the high light sensitivity and the prevention of the occurrence of the black spots, a mass ratio of the hole transporting material to the electron transporting material (a mass of the hole transporting material/a mass of the electron transporting material) is preferably 19/5 or more and 28/5 or less, more preferably 20/5 or more and 26/5 or less, and still more preferably 21/5 or more and 24/5 or less.

Electron Transporting Material

The electron transporting material is not particularly limited, and examples thereof include: a quinone-based compound such as chloranil and bromoanil; a tetracyanoquinodimethane-based compound; a fluorenone-based compound such as 2,4,7-trinitro-9-fluorenone, 2,4,5,7-tetranitro-9-fluorenone, and octyl 9-dicyanomethylene-9-fluorenone-4-carboxylatel; an oxadiazole-based compound such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; a xanthone-based compound; a thiophene-based compound; a dinaphthoquinone-based compound such as 3,3'-di-tert-pentyl-dinaphthoquinone; a diphenoquinone-based compound such as 3,3'-di-tert-butyl-5,5'-dimethyldiphenoquinone and 3,3',5,5'-tetra-tert-butyl-4,4'-diphenoquinone; and a polymer having a group in the main chain or the side chain and composed of the above compounds. These electron transporting materials may be used alone or in combination of two or more thereof.

Among these, from the viewpoints of controlling the above volume resistivity of the photoconductive layer before wear and the above volume resistivity of the photoconductive layer after wear as well as the above amount ratio of the electron transporting material, and preventing the occurrence of the black spots while having the high light sensitivity, the electron transporting material is preferably an electron transporting material having a diphenoquinone skeleton, and more preferably an electron transporting material represented by the following general formula (FK).

(FK)

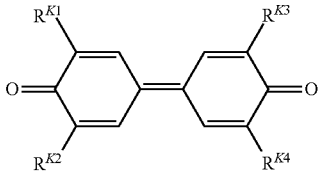

In the general formula (FK), $R^{k1}$ to $R^{k4}$ each independently represent a hydrogen atom, an alkyl group having 1 or more and 12 or less carbon atoms, an alkoxy group having 1 or more and 12 or less carbon atoms, a cycloalkyl group, an aryl group, or an aralkyl group.

$R^{k1}$ is preferably a group different from at least one of $R^{k2}$ to $R^{k4}$.

From the viewpoint of preventing cracking of the photoconductive layer due to crystallization of the electron transporting material, $R^{k1}$ and $R^{k3}$ are each independently preferably an alkyl group having 3 or more and 12 or less carbon atoms, an alkoxy group having 3 or more and 12 or less carbon atoms, a cycloalkyl group, an aryl group, or an aralkyl group, more preferably a branched alkyl group having 3 or more and 12 or less carbon atoms, a branched alkoxy group having 3 or more and 12 or less carbon atoms, a cycloalkyl group, an aryl group, or an aralkyl group, still more preferably a branched alkyl group having 3 or more and 8 or less carbon atoms or a branched alkoxy group having 3 or more and 8 or less carbon atoms, and particularly preferably a t-butyl group.

Further, $R^{k1}$ and $R^{k3}$ are preferably the same group.

$R^{k2}$ and $R^{k4}$ are each independently preferably a hydrogen atom, an alkyl group having 1 or more and 8 or less carbon atoms, or an alkoxy group having 1 or more and 8 or less carbon atoms, more preferably a hydrogen atom, a linear alkyl group having 1 or more and 4 or less carbon atoms, or a linear alkoxy group having 1 or more and 4 or less carbon atoms, still more preferably a linear alkyl group having 1 or more and 3 or less carbon atoms or a linear alkoxy group having 1 or more and 3 or less carbon atoms, and particularly preferably a methyl group.

Further, $R^{k2}$ and $R^{k4}$ are preferably the same group.

Furthermore, $R^{k1}$ and $R^{k2}$ are preferably different groups, and $R^{k3}$ and $R^{k4}$ are preferably different groups.

Hereinafter, exemplified compounds 1 to 7 exemplified by $R^{k1}$ to $R^{k4}$ of the electron transporting material represented by the general formula (FK) are shown, but the electron transporting material represented by the general formula (FK) is not limited to the exemplified compounds 1 to 7 An exemplified compound represented by each of the following numbers is also referred to as the "exemplified compound (1-number)". Specifically, for example, the "exemplified compound 5" is also referred to as the "exemplified compound (1-5)".

| Exemplified Compound | $R^{k1}$ | $R^{k2}$ | $R^{k3}$ | $R^{k4}$ |
|---|---|---|---|---|
| 1 | t-$C_4H_9$ | $CH_3$ | t-$C_4H_9$ | $CH_3$ |
| 2 | t-$C_4H_9$ | H | t-$C_4H_9$ | H |
| 3 | t-$C_4H_9$ | $CH_3O$ | t-$C_4H_9$ | $CH_3O$ |
| 4 | t-$C_4H_9O$ | $CH_3$ | t-$C_4H_9O$ | $CH_3$ |
| 5 | c-$C_6H_{11}$ | $CH_3$ | c-$C_6H_{11}$ | $CH_3$ |
| 6 | $C_6H_5$ | $CH_3$ | $C_6H_5$ | $CH_3$ |
| 7 | $C_6H_5CH_2$ | $CH_3$ | $C_6H_5CH_2$ | $CH_3$ |

Abbreviations and the like in the above exemplified compounds indicate the following meanings.

t-$C_4H_9$: t-butyl group
$CH_3O$: methoxy group
t-$C_4H_9O$: t-butoxy group
c-$C_6H_{11}$: cyclohexyl group
$C_6H_5$: phenyl group
$C_6H_5CH_2$: benzyl group A content of the electron transporting material with respect to the total solid content of the photoconductive layer is preferably 4 mass % or more and 20 mass % or less, more preferably 6 mass % or more and 18 mass % or less, and still more preferably 8 mass % or more and 16 mass % or less.

Other Additives

The single-layer-type photoconductive layer may contain other well-known additives such as an antioxidant, a light stabilizer, and a thermal stabilizer. Further, when the single-layer-type photoconductive layer serves as a surface layer, the single-layer-type photoconductive layer may contain fluorine resin particles, silicone oil, or the like.

Formation of Single-Layer-Type Photoconductive Layer

The single-layer-type photoconductive layer is formed using a photoconductive layer-forming coating liquid in which the above components are added to a solvent.

Examples of the solvent include ordinary organic solvents such as aromatic hydrocarbons such as benzene, toluene, xylene, and chlorobenzene, ketones such as acetone and 2-butanone, halogenated aliphatic hydrocarbons such as methylene chloride, chloroform, and ethylene chloride, and cyclic or linear ethers such as tetrahydrofuran and ethyl ether. These solvents are used alone or in combination of two or more thereof.

As a method for dispersing particles (for example, the charge generating material) in the photoconductive layer-forming coating liquid, a media disperser such as a ball mill, a vibration ball mill, an attritor, a sand mill, or a horizontal sand mill, or a medialess disperser such as a stirrer, an ultrasonic disperser, a roll mill, or a high-pressure homogenizer is used. Examples of the high-pressure homogenizer include a collision type in which a dispersion liquid is dispersed by liquid-liquid collision or liquid-wall collision in a high-pressure state, and a penetration type in which a dispersion liquid is dispersed by penetrating a fine flow path in a high-pressure state.

Examples of a method for coating the photoconductive layer-forming coating liquid onto the undercoat layer include a dip coating method, a push-up coating method, a wire bar coating method, a spray coating method, a blade coating method, a knife coating method, and a curtain coating method.

A film thickness of the single-layer-type photoconductive layer is preferably set in a range of 5 μm or more and 60 μm or less, more preferably 5 μm or more and 50 μm or less, and still more preferably 10 μm or more and 40 μm or less.

Image Forming Apparatus (and Process Cartridge)

The image forming apparatus according to the exemplary embodiment includes: an electrophotographic photoconductor; a charging unit configured to charge a surface of the electrophotographic photoconductor; an electrostatic latent image forming unit configured to form an electrostatic latent image on the charged surface of the electrophotographic photoconductor; a developing unit configured to develop, by using a developer containing a toner, the electrostatic latent image formed on the surface of the electrophotographic photoconductor so as to form a toner image; and a transfer unit configured to transfer the toner image onto a surface of a recording medium. As the electrophotographic photoconductor, the above electrophotographic photoconductor according to the exemplary embodiment is used.

The image forming apparatus according to the exemplary embodiment is applied to a well-known image forming apparatus such as: an apparatus including a fixing unit that fixes a toner image transferred to a surface of a recording medium; a direct transfer type apparatus that directly transfers a toner image formed on a surface of an electrophotographic photoconductor onto a recording medium; an intermediate transfer type apparatus that primarily transfers a toner image formed on a surface of an electrophotographic photoconductor onto a surface of an intermediate transfer body and secondarily transfers the toner image transferred to the surface of the intermediate transfer body onto a surface of a recording medium; an apparatus including a cleaning unit that cleans a surface of an electrophotographic photoconductor after transfer of a toner image and before charging; an apparatus including an discharging unit that irradiates a surface of an electrophotographic photoconductor with a discharging light for discharging after transfer of a toner image and before charging; and an apparatus including an electrophotographic photoconductor heating member for increasing a temperature of an electrophotographic photoconductor and reducing a relative humidity.

In the case of an intermediate transfer type apparatus, the transfer unit includes, for example, an intermediate transfer body on which a toner image is transferred to a surface, a primary transfer unit that primarily transfers the toner image formed on a surface of an electrophotographic photoconductor onto the surface of the intermediate transfer body, and a secondary transfer unit that secondarily transfers the toner image transferred on the surface of the intermediate transfer body onto a surface of a recording medium.

The image forming apparatus according to the exemplary embodiment may be either a dry developing type image forming apparatus or a wet developing type (development type using a liquid developer) image forming apparatus.

In the image forming apparatus according to the exemplary embodiment, for example, a portion including the electrophotographic photoconductor may be a cartridge structure (process cartridge) that is attached to and detached from the image forming apparatus. As the process cartridge, for example, a process cartridge including the electrophotographic photoconductor according to the exemplary embodiment is suitably used. In addition to the electrophotographic photoconductor, the process cartridge may include, for example, at least one selected from the group consisting of a charging unit, an electrostatic latent image forming unit, a developing unit, and a transfer unit.

Hereinafter, an example of the image forming apparatus according to the exemplary embodiment will be described, but the image forming apparatus is not limited thereto. Main parts shown in the drawings will be described, and descriptions of other parts will be omitted.

Figure 2:
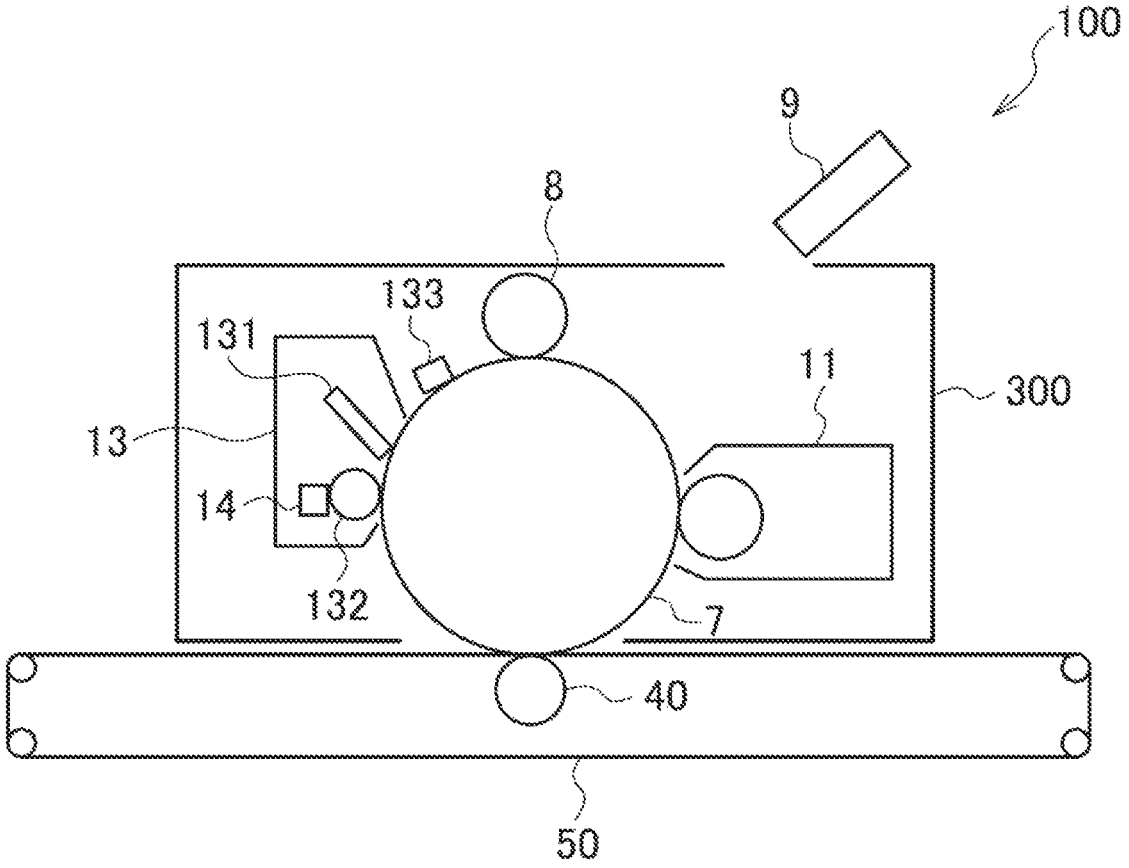
FIG. 2 is a schematic configuration diagram illustrating an example of an image forming apparatus according to an exemplary embodiment.

FIG. 2 is a schematic configuration diagram illustrating an example of the image forming apparatus according to the exemplary embodiment.

As shown in FIG. 2, an image forming apparatus 100 according to the exemplary embodiment includes a process cartridge 300 including an electrophotographic photoconductor 7, an exposure device 9 (an example of the electrostatic latent image forming unit), and a transfer device 40 (an example of the transfer unit). In the image forming apparatus 100, the exposure device 9 is disposed at a position where the electrophotographic photoconductor 7 may be exposed from an opening of the process cartridge 300, and the transfer device 40 is disposed at a position facing the electrophotographic photoconductor 7 via a recording medium transport belt 50.

The process cartridge 300 shown in FIG. 2 integrally supports, in a housing, the electrophotographic photoconductor 7, a charging device 8 (an example of the charging unit), a developing device 11 (an example of the developing unit), and a cleaning device 3 (an example of a cleaning unit). The cleaning device 13 includes a cleaning blade 131 (an example of a cleaning member), and the cleaning blade 131 is disposed to be in contact with a surface of the electrophotographic photoconductor 7. The cleaning member may be a conductive or insulating fibrous member instead of the form of the cleaning blade 131, and the fibrous member may be used alone or in combination with the cleaning blade 131.

FIG. 2 shows an example in which the image forming apparatus includes a fibrous member 132 (roll shape) that supplies a lubricant 14 to the surface of the electrophotographic photoconductor 7, and a fibrous member 133 (flat brush shape) that assists the cleaning, but these members are disposed as necessary.

Hereinafter, each configuration of the image forming apparatus according to the exemplary embodiment will be described.

Charging Device

As the charging device 8, for example, a contact type charger using a conductive or semiconductive charging roller, a charging brush, a charging film, a charging rubber blade, or a charging tube is used. Further, a charger, which is well known per se, such as a non-contact type roller charger, and a scorotron charger or a corotron charger using corona discharge, is also used.

Exposure Device

Examples of the exposure device 9 include an optical device that exposes the surface of the electrophotographic photoconductor 7 with a light such as a semiconductor laser light, an LED light, or a liquid crystal shutter light in a predetermined image pattern. A wavelength of the light source is within a spectral sensitivity range of the electrophotographic photoconductor. A mainstream wavelength of a semiconductor laser is near infrared, which has an oscillation wavelength in the vicinity of 780 nm. However, the present invention is not limited to this wavelength, and a laser having an oscillation wavelength of about 600 nm or a blue laser having an oscillation wavelength of 400 nm or more and 450 nm or less also may be used. Further, in order to form a color image, a surface emitting type laser light source capable of outputting a multiple beam is also effective.

Developing Device

Examples of the developing device 11 include a general developing device in which a developer is used in a contact or non-contact manner to perform developing. The developing device 11 is not particularly limited as long as the above function is provided, and is selected according to a purpose. Examples thereof include a well-known developing device provided with a function of attaching a one-component developer or a two-component developer to the electrophotographic photoconductor 7 using a brush, a roller, or the like. Among these, one using a developing roller in which a developer is held on a surface is preferred.

The developer used in the developing device 11 may be a one-component developer using only a toner or a two-component developer containing a toner and a carrier. Further, the developer may be magnetic or non-magnetic. As these developers, well-known developers are used.

Cleaning Device

As the cleaning device 13, a cleaning blade type device including the cleaning blade 131 is used.

In addition to the cleaning blade type, a fur brush cleaning type or a simultaneous development cleaning type may be adopted.

Transfer Device

Examples of the transfer device 40 include a transfer charger, which is well known per se, such as a contact type transfer charger using a belt, a roller, a film, a rubber blade, or the like, and a scorotron transfer charger or a corotron transfer charger using corona discharge.

Recording Medium Transport Belt

As the recording medium transport belt 50, a belt-shaped belt (intermediate transfer belt) containing semi-conductive polyimide, polyamideimide, polycarbonate, polyarylate, polyester, rubber, and the like is used.

Figure 3:
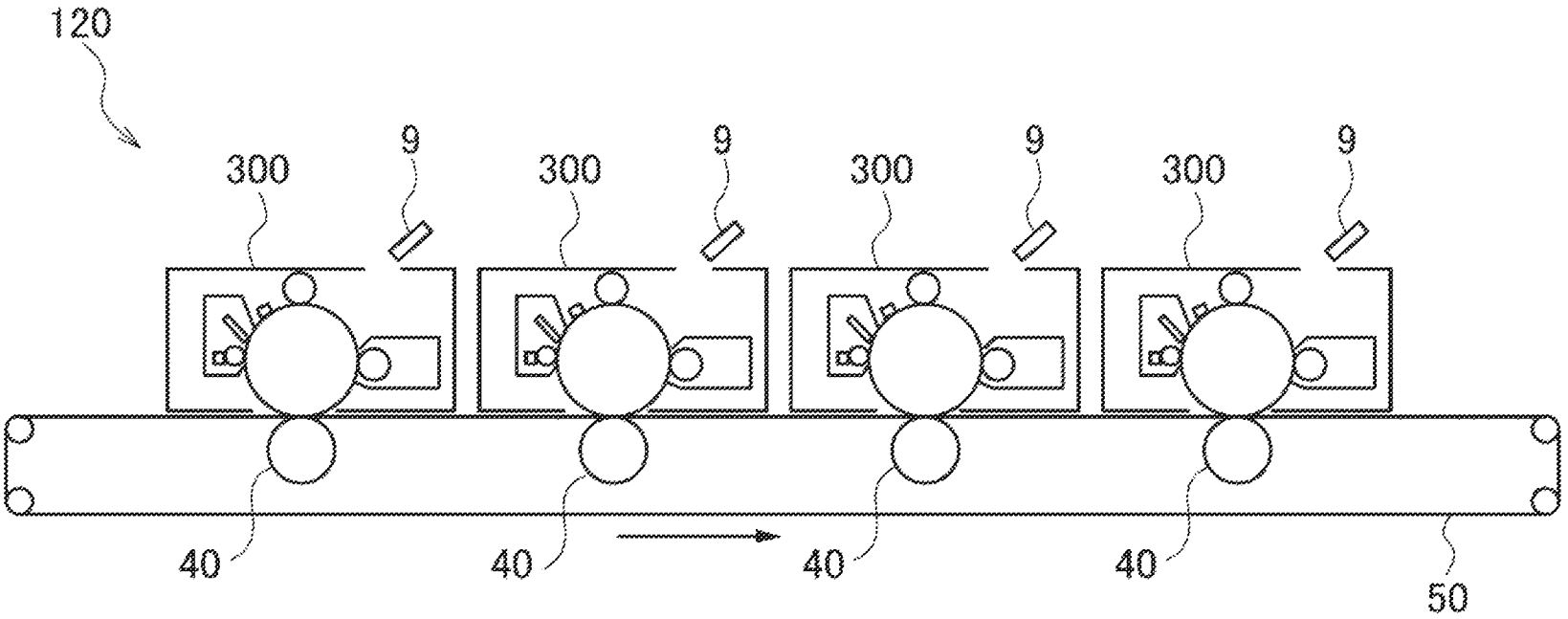
FIG. 3 is a schematic configuration diagram illustrating another example of the image forming apparatus according to the exemplary embodiment.

FIG. 3 is a schematic configuration diagram illustrating another example of the image forming apparatus according to the exemplary embodiment.

An image forming apparatus 120 shown in FIG. 3 is a tandem type multicolor image forming apparatus in which four process cartridges 300 are mounted. In the image forming apparatus 120, four process cartridges 300 are arranged in parallel on an intermediate transfer body 50, and one electrophotographic photoconductor is used for one color. The image forming apparatus 120 has the same configuration as that of the image forming apparatus 100 except that the image forming apparatus 120 is of a tandem type.

Here, in the image forming apparatus according to the exemplary embodiment, when the image forming apparatus includes a direct transfer type transfer unit including a transfer member that transfers the toner image directly from the electrophotographic photoconductor to the surface of the recording medium, it is preferable that a relationship among a rotation speed P (mm/s) of the electrophotographic photoconductor, a transfer current value I (μA) for transferring the toner image directly from the electrophotographic photoconductor to the surface of the recording medium, and a length L (mm) of the transfer member satisfies the following expression (PIL).

$$-1.07\times10^{-3} \leq I/(P\times L) \leq -4.30\times10^{-4} \quad \text{expression (PIL)}$$

The I/(P×L) value theoretically indicates an amount of charges received by the electrophotographic photoconductor from the transfer member during direct transfer.

The rotation speed P of the electrophotographic photoconductor is a moving amount (also referred to as a "process speed") per unit time (1 second) in which the surface of the electrophotographic photoconductor moves in a circumferential direction.

The transfer current value is a current value that is applied to the transfer member when the toner image is directly transferred from the electrophotographic photoconductor onto the surface of the recording medium.

The length of the transfer member is a length in a direction along an axial direction of the electrophotographic photoconductor in a region facing the photoconductive layer of the electrophotographic photoconductor.

As the transfer member, a contact type transfer member such as a transfer roll may be adopted.

When the above electrophotographic photoconductor according to the exemplary embodiment is applied and direct transfer is performed under a condition in which the I/(P×L) value is within the above range, excessive charge injection from the transfer member to the electrophotographic photoconductor during transfer is prevented and a negative ghost in which an image portion in a previous image is thinly raised is prevented, insufficient charge injection from the transfer member to the electrophotographic photoconductor during transfer is prevented and a negative ghost in which the image portion in the previous image is deeply raised is prevented. As a result, a ghost (afterimage phenomenon caused by a remaining history of the previous image) during a period from a beginning to an end of a lifetime of the electrophotographic photoconductor is prevented.

From the viewpoint of preventing the ghost, the I/(P×L) value is more preferably $-8.60\times10^{-4}$ or more and $-3.43\times10^{-4}$ or less, and still more preferably $-6.40\times10^{-4}$ or more and $-4.30\times10^{-4}$ or less.

EXAMPLES

Hereinafter, the present invention will be described more specifically based on Examples and Comparative Examples, but the present invention is not limited to the following Examples at all. Unless otherwise specified, "part" indicates "part by mass", and "%" indicates "mass %".

Examples 1 to 17 and Comparative Examples 1 to 7

Production of Photoconductive Layer-Forming Coating Liquid

A photoconductive layer-forming coating liquid is obtained by dispersing, in a high-pressure homogenizer, a mixture of a bisphenol Z polycarbonate resin (polycarbonate resin represented by the above formula PC-1, pm:25, pn:75, viscosity average molecular weight: 50,000), a charge generating material shown in Table 1 ("CGM" in Table 1), a hole transporting material shown in Table 1 ("HTM" in Table 1), an electron transporting material shown in Table 1 ("ETM" in Table 1), and tetrahydrofuran in an amount corresponding to a solid content concentration shown in Table 1.

Formation of Photoconductive Layer

As a conductive substrate, an aluminum substrate having a diameter of 30 mm, a length of 244.5 mm, and a thickness of 1 mm is prepared.

Next, under photoconductive layer forming conditions shown in Table 1, the photoconductive layer-forming coating liquid is coated onto the aluminum substrate using a dip coating method, and dried and cured to form a single-layer-type photoconductive layer having a thickness of 30 μm on the aluminum substrate.

In this way, a photoconductor of each Example is obtained.

Characteristics

The following characteristics of the photoconductor of each Example are measured according to the methods described above.

Volume resistivity of the photoconductive layer after wear when a ratio of a thickness of the photoconductive layer after wear to a thickness of the photoconductive layer before wear (the thickness of the photoconductive layer after wear/the thickness of the photoconductive layer before wear) is 0.8

Volume resistivity of the photoconductive layer before wear

Ratio of an amount of the electron transporting material on a front surface of the photoconductive layer to an amount of the electron transporting material on a back surface of the photoconductive layer (expressed as "ETM amount ratio between front surface and back surface of photoconductive layer" in the table)

Evaluations

The following evaluations are carried out using the photoconductor of each Example.

Evaluation of Chargeability

Using an electrostatic copy paper tester (electrostatic analyzer EPA 8100, manufactured by Kawaguchi Electric Works Co., Ltd.), a surface potential is measured 0.5 seconds after the photoconductor is positively charged by performing 6.0 kV corona discharge.

The chargeability is evaluated as good when the surface potential is 780 V or more.

Evaluation of Light Sensitivity

The light sensitivity of the photoconductor is evaluated as a half decay exposure amount when the photoconductor is charged to +800 V. Specifically, the photoconductor is charged to +800 V in an environment of 20° C. and 40% RH by using an electrostatic copy paper tester (electrostatic analyzer EPA 8100, manufactured by Kawaguchi Electric Works Co., Ltd.), and then a light of a tungsten lamp is converted into a monochromatic light of 780 nm using a monochromator, and adjusted to 1 $\mu W/cm^2$ on the surface of the photoconductor for irradiation.

Then, a surface potential V0 (V) of the surface of the photoconductor immediately after charging and a half decay exposure amount $E_{1/2}$ ($\mu J/cm^2$) at which the surface potential is 1/2×V0 (V) by light irradiation on the surface of the photoconductor are measured.

The light sensitivity is evaluated as a high sensitivity when a half decay exposure amount of 0.15 $\mu J/cm^2$ or less is obtained.

Evaluation of Black Spots

In the evaluation of black spots, a 50% halftone image is printed after printing an image specified in ISO/IEC 19752 on A4 paper for 30,000 pages under high temperature and high humidity of 30° C. and 80% RH by using HL5340D manufactured by Brother Industries, Ltd., and black spots on the image are evaluated according to the following criteria.

When the evaluation is 3, it is evaluated that a problem may occur in practical use.

Evaluation Criteria

1: No black spots
2: Some black spots are found but acceptable
3: Black spots are found and unacceptable Evaluation of Ghost The photoconductor of each Example is mounted on an image forming apparatus "HL-L5200DW manufactured by Brother Industries, Ltd. (a direct transfer type apparatus including a transfer roll having a length L of 235 mm)".

Then, transfer conditions of a process speed and a transfer current value are set to respective conditions of transfer conditions 1+3, transfer conditions 2+3, transfer conditions 1+4, and transfer conditions 2+4 shown in Table 3, and an image is formed as follows.

Under high temperature and high humidity of 32.5° C. and 80% RH, a 20 mm×20 mm image having an image density of 100% is output, further an A4 full-face halftone 30% image is continuously output, and a density variation on the halftone after one round of the photoconductor is visually evaluated.

Then, the occurrence status of the ghost of the 10th printed matter (indicated as an "initial ghost" in the table) and the ghost of the 500,000th printed matter (indicated as a "ghost after 50 kpv" in the table) are evaluated according to the following criteria.

In a ghost column in Table 3, expression of numerical value/numerical value/numerical value/numerical value means evaluation result of transfer condition 1+3/evaluation result of transfer condition 2+3/evaluation result of transfer condition 1+4/evaluation result of transfer condition 2+4. An image output unit having an image density of 100% is represented by 1 to 3 when the density is higher, and represented by −1 to −3 when the density is lower on an A4 halftone portion 30% image.

Evaluation Criteria

3: A clear density variation is found, and is unacceptable in image quality

2: A density variation is found, but no problem is found in practical use

1: A slight density variation is found, but no problem is found in practical use 0: No density variation −1: A slight density variation is found, but no problem is found in practical use −2: A density variation is found, but no problem is found in practical use −3: A clear density variation is found, and is unacceptable in image quality

TABLE 1

| | Photoconductive layer-forming coating liquid | | | | | | | | | | | Photoconductive layer forming condition | | | |
|---|---|---|---|---|---|---|---|---|---|---|---|---|---|---|---|
| | Binder resin | | CGM | | HTM | | | ETM | | HTM/ETM amount ratio | Solid content concentration | Coating liquid temperature | Room temperature | Drying Temperature | Drying Time |
| | Type | Part | Type | Part | Type | Part | mass %*1 | Type | Part | | (%) | (° C.) | (° C.) | (° C.) | (min) |
| Example 1 | PC-1 | 49.5 | CGM-A | 1.5 | HTM-A | 41 | 41 | ETM-A | 8 | 5.13 | 20% | 30 | 25 | 115 | 25 |
| Example 2 | PC-1 | 49.5 | CGM-A | 1.5 | HTM-A | 41 | 41 | ETM-A | 8 | 5.13 | 20% | 28 | 25 | 115 | 25 |
| Example 3 | PC-1 | 49.5 | CGM-A | 1.5 | HTM-A | 41 | 41 | ETM-A | 8 | 5.13 | 20% | 25 | 20 | 115 | 25 |
| Example 4 | PC-1 | 49.5 | CGM-A | 1.5 | HTM-A | 41 | 41 | ETM-A | 8 | 5.13 | 17% | 20 | 15 | 115 | 25 |
| Example 5 | PC-1 | 49.5 | CGM-A | 1.5 | HTM-A | 41 | 41 | ETM-A | 8 | 5.13 | 20% | 25 | 20 | 100 | 25 |
| Example 6 | PC-1 | 50.5 | CGM-A | 1.5 | HTM-A | 39 | 39 | ETM-A | 9 | 4.33 | 20% | 28 | 25 | 115 | 25 |
| Example 7 | PC-1 | 50.5 | CGM-A | 1.5 | HTM-A | 38 | 38 | ETM-A | 10 | 3.80 | 20% | 28 | 25 | 115 | 25 |
| Example 8 | PC-1 | 49 | CGM-A | 1.5 | HTM-A | 42 | 42 | ETM-A | 7.5 | 5.60 | 20% | 30 | 25 | 115 | 25 |
| Example 9 | PC-1 | 46.5 | CGM-A | 1.5 | HTM-A | 44 | 44 | ETM-A | 8 | 5.50 | 20% | 28 | 25 | 115 | 25 |
| Example 10 | PC-1 | 49.5 | CGM-A | 1.5 | HTM-A | 41 | 41 | ETM-B | 8 | 5.13 | 20% | 28 | 25 | 115 | 25 |
| Example 11 | PC-1 | 49.5 | CGM-A | 1.5 | HTM-A | 41 | 41 | ETM-B | 8 | 5.13 | 20% | 28 | 25 | 95 | 25 |
| Example 12 | PC-1 | 49.5 | CGM-A | 1.5 | HTM-A | 41 | 41 | ETM-B | 8 | 5.13 | 20% | 28 | 25 | 135 | 25 |
| Comparative Example 1 | PC-1 | 49.5 | CGM-A | 1.5 | HTM-A | 41 | 41 | ETM-A | 8 | 5.13 | 20% | 25 | 30 | 100 | 25 |
| Comparative Example 2 | PC-1 | 49.5 | CGM-A | 1.5 | HTM-A | 41 | 41 | ETM-A | 8 | 5.13 | 20% | 32 | 25 | 145 | 25 |
| Comparative Example 3 | PC-1 | 46.5 | CGM-A | 1.5 | HTM-A | 44 | 44 | ETM-A | 8 | 5.50 | 26% | 28 | 30 | 125 | 25 |
| Example 13 | PC-1 | 49.5 | CGM-A | 1.5 | HTM-A | 41 | 41 | ETM-A | 8 | 5.13 | 26% | 28 | 25 | 100 | 25 |
| Example 14 | PC-1 | 50.5 | CGM-A | 1.5 | HTM-A | 41 | 41 | ETM-A | 7 | 5.86 | 20% | 28 | 25 | 115 | 25 |
| Example 15 | PC-1 | 49 | CGM-A | 1.5 | HTM-A | 39 | 39 | ETM-A | 10.5 | 3.71 | 20% | 28 | 25 | 115 | 25 |
| Example 16 | PC-1 | 52.5 | CGM-A | 1.5 | HTM-A | 37 | 37 | ETM-A | 9 | 4.11 | 20% | 28 | 25 | 115 | 25 |
| Comparative Example 4 | PC-1 | 49.5 | CGM-A | 1.5 | HTM-A | 41 | 41 | ETM-C | 8 | 5.13 | 20% | 28 | 25 | 115 | 25 |
| Comparative Example 5 | PC-1 | 49.5 | CGM-A | 1.5 | HTM-A | 41 | 41 | ETM-A | 8 | 5.13 | 26% | 28 | 30 | 95 | 25 |
| Example 17 | PC-1 | 49.5 | CGM-A | 1.5 | HTM-A | 41 | 41 | ETM-C | 8 | 5.13 | 20% | 25 | 30 | 145 | 25 |
| Comparative Example 6 | PC-1 | 50.5 | CGM-A | 1.5 | HTM-B | 38 | 38 | ETM-A | 10 | 3.80 | 20% | 28 | 25 | 115 | 25 |
| Comparative Example 7 | PC-1 | 50.5 | CGM-A | 1.5 | HTM-B | 38 | 38 | ETM-C | 10 | 3.80 | 20% | 28 | 25 | 115 | 25 |

*1: a content (mass %) of the hole transporting material with respect to the total solid content of the photoconductive layer

TABLE 2

| | Volume resistivity of photoconductive layer | | | ETM amount ratio between front surface and back surface of photoconductive layer | Evaluation | | |
|---|---|---|---|---|---|---|---|
| | Before wear Ω · cm | After wear Ω · cm | After wear/before wear — | | Chargeability (surface potential V) | Light Sensitivity (E1/2 (μJ/cm2)) | Black Spots |
| Example 1 | $4.6 \times 10^{12}$ | $5.0 \times 10^{10}$ | 0.011 | 0.22 | 795 | 0.13 | 1 |
| Example 2 | $4.2 \times 10^{12}$ | $6.8 \times 10^{10}$ | 0.016 | 0.22 | 800 | 0.13 | 1 |
| Example 3 | $3.4 \times 10^{12}$ | $1.5 \times 10^{11}$ | 0.044 | 0.22 | 810 | 0.12 | 1 |
| Example 4 | $2.9 \times 10^{12}$ | $2.0 \times 10^{11}$ | 0.069 | 0.22 | 810 | 0.12 | 1 |
| Example 5 | $5.5 \times 10^{12}$ | $1.8 \times 10^{11}$ | 0.033 | 0.19 | 810 | 0.14 | 1 |

TABLE 2-continued

| | Volume resistivity of photoconductive layer | | | ETM amount ratio between front surface and back | Evaluation | | |
|---|---|---|---|---|---|---|---|
| | Before wear Ω · cm | After wear Ω · cm | After wear/ before wear — | surface of photoconductive layer | Chargeability (surface potential V) | Light Sensitivity (E1/2 (μJ/cm2)) | Black Spots |
| Example 6 | $4.5 \times 10^{12}$ | $1.9 \times 10^{11}$ | 0.042 | 0.22 | 800 | 0.13 | 1 |
| Example 7 | $4.5 \times 10^{12}$ | $2.0 \times 10^{11}$ | 0.044 | 0.22 | 800 | 0.13 | 1 |
| Example 8 | $2.5 \times 10^{12}$ | $5.5 \times 10^{10}$ | 0.022 | 0.22 | 790 | 0.12 | 1 |
| Example 9 | $1.9 \times 10^{12}$ | $5.0 \times 10^{10}$ | 0.026 | 0.22 | 780 | 0.12 | 1 |
| Example 10 | $4.0 \times 10^{12}$ | $7.2 \times 10^{10}$ | 0.018 | 0.22 | 800 | 0.13 | 1 |
| Example 11 | $8.2 \times 10^{12}$ | $4.9 \times 10^{10}$ | 0.006 | 0.17 | 810 | 0.15 | 1 |
| Example 12 | $9.4 \times 10^{11}$ | $5.1 \times 10^{10}$ | 0.054 | 0.32 | 780 | 0.14 | 1 |
| Comparative Example 1 | $9.1 \times 10^{12}$ | $4.8 \times 10^{10}$ | 0.005 | 0.16 | 780 | 0.16 | 3 |
| Comparative Example 2 | $1.2 \times 10^{12}$ | $2.3 \times 10^{11}$ | 0.192 | 0.34 | 750 | 0.16 | 3 |
| Comparative Example 3 | $6.8 \times 10^{11}$ | $4.9 \times 10^{10}$ | 0.072 | 0.34 | 750 | 0.16 | 3 |
| Example 13 | $5.6 \times 10^{12}$ | $5.1 \times 10^{10}$ | 0.009 | 0.16 | 810 | 0.16 | 1 |
| Example 14 | $4.2 \times 10^{12}$ | $7.6 \times 10^{10}$ | 0.018 | 0.21 | 810 | 0.13 | 1 |
| Example 15 | $6.0 \times 10^{12}$ | $9.1 \times 10^{10}$ | 0.015 | 0.16 | 830 | 0.16 | 2 |
| Example 16 | $8.2 \times 10^{12}$ | $1.2 \times 10^{11}$ | 0.015 | 0.15 | 830 | 0.17 | 2 |
| Comparative Example 4 | $2.5 \times 10^{12}$ | $8.0 \times 10^{9}$ | 0.003 | 0.34 | 800 | 0.16 | 3 |
| Comparative Example 5 | $8.9 \times 10^{12}$ | $4.5 \times 10^{10}$ | 0.005 | 0.15 | 800 | 0.15 | 3 |
| Example 17 | $9.8 \times 10^{11}$ | $5.0 \times 10^{10}$ | 0.041 | 0.4 | 770 | 0.15 | 2 |
| Comparative Example 6 | $1.1 \times 10^{13}$ | $4.5 \times 10^{10}$ | 0.026 | 0.37 | 800 | 0.1 | 3 |
| Comparative Example 7 | $2.8 \times 10^{13}$ | $2.0 \times 10^{10}$ | 0.026 | 0.37 | 800 | 0.1 | 3 |

TABLE 3

| | Transfer condition | | | | | | | | Evaluation of Ghost | |
|---|---|---|---|---|---|---|---|---|---|---|
| | Process speed P (mm/s) | | Transfer current value I (μA) | | I/(P × L) value (where L = 235 mm) | | | | | |
| | Condition 1 | Condition 2 | Condition 3 | Condition 4 | Conditions 1 + 3 | Conditions 2 + 3 | Conditions 1 + 4 | Conditions 2 + 4 | Initial Ghost | Ghost after 50 kpv |
| Example 1 | 198 | 248 | −20 | −50 | −4.30E−04 | −3.43E−04 | −1.07E−03 | −8.58E−04 | 1/1/0/0 | 2/2/0/0 |
| | 198 | 248 | −19 | −51 | −4.08E−04 | −3.26E−04 | −1.10E−03 | −8.75E−04 | 2/3/1/1 | 3/3/1/1 |
| Example 2 | 198 | 248 | −20 | −50 | −4.30E−04 | −3.43E−04 | −1.07E−03 | −8.58E−04 | 1/1/0/0 | 2/2/0/0 |
| | 198 | 248 | −19 | −51 | −4.08E−04 | −3.26E−04 | −1.10E−03 | −8.75E−04 | 2/3/1/1 | 3/3/1/1 |
| Example 3 | 198 | 248 | −20 | −50 | −4.30E−04 | −3.43E−04 | −1.07E−03 | −8.58E−04 | 1/1/0/0 | 2/2/0/0 |
| | 198 | 248 | −19 | −51 | −4.08E−04 | −3.26E−04 | −1.10E−03 | −8.75E−04 | 2/3/1/1 | 3/3/1/1 |
| Example 4 | 198 | 248 | −20 | −50 | −4.30E−04 | −3.43E−04 | −1.07E−03 | −8.58E−04 | 1/1/0/0 | 2/2/0/0 |
| | 198 | 248 | −19 | −51 | −4.08E−04 | −3.26E−04 | −1.10E−03 | −8.75E−04 | 2/3/1/1 | 3/3/1/1 |
| Example 5 | 198 | 248 | −20 | −50 | −4.30E−04 | −3.43E−04 | −1.07E−03 | −8.58E−04 | 1/1/0/0 | 2/2/0/0 |
| | 198 | 248 | −19 | −51 | −4.08E−04 | −3.26E−04 | −1.10E−03 | −8.75E−04 | 2/3/1/1 | 3/3/1/1 |
| Example 6 | 198 | 248 | −20 | −50 | −4.30E−04 | −3.43E−04 | −1.07E−03 | −8.58E−04 | 1/2/0/0 | 2/2/0/0 |
| | 198 | 248 | −19 | −51 | −4.08E−04 | −3.26E−04 | −1.10E−03 | −8.75E−04 | 3/3/1/1 | 3/3/2/2 |
| Example 7 | 198 | 248 | −20 | −50 | −4.30E−04 | −3.43E−04 | −1.07E−03 | −8.58E−04 | 2/2/−1/0 | 2/2/0/0 |
| | 198 | 248 | −19 | −51 | −4.08E−04 | −3.26E−04 | −1.10E−03 | −8.75E−04 | 2/3/−1/0 | 3/3/−3/−1 |
| Example 8 | 198 | 248 | −20 | −50 | −4.30E−04 | −3.43E−04 | −1.07E−03 | −8.58E−04 | 0/0/0/0 | 1/1/0/0 |
| | 198 | 248 | −19 | −51 | −4.08E−04 | −3.26E−04 | −1.10E−03 | −8.75E−04 | 0/1/−2/0 | 2/3/−2/0 |
| Example 9 | 198 | 248 | −20 | −50 | −4.30E−04 | −3.43E−04 | −1.07E−03 | −8.58E−04 | 0/0/0/0 | 1/1/0/0 |
| | 198 | 248 | −19 | −51 | −4.08E−04 | −3.26E−04 | −1.10E−03 | −8.75E−04 | 0/1/−2/0 | 2/3/−2/0 |
| Example 10 | 198 | 248 | −20 | −50 | −4.30E−04 | −3.43E−04 | −1.07E−03 | −8.58E−04 | 1/1/0/0 | 2/2/0/0 |
| | 198 | 248 | −19 | −51 | −4.08E−04 | −3.26E−04 | −1.10E−03 | −8.75E−04 | 2/3/1/1 | 3/3/1/1 |
| Example 11 | 198 | 248 | −20 | −50 | −4.30E−04 | −3.43E−04 | −1.07E−03 | −8.58E−04 | 1/1/0/0 | 2/2/0/0 |
| | 198 | 248 | −19 | −51 | −4.08E−04 | −3.26E−04 | −1.10E−03 | −8.75E−04 | 2/3/1/1 | 3/3/1/1 |
| Example 12 | 198 | 248 | −20 | −50 | −4.30E−04 | −3.43E−04 | −1.07E−03 | −8.58E−04 | 1/1/0/0 | 2/2/0/0 |
| | 198 | 248 | −19 | −51 | −4.08E−04 | −3.26E−04 | −1.10E−03 | −8.75E−04 | 2/3/1/1 | 3/3/1/1 |

TABLE 3-continued

| | Transfer condition | | | | | | | | | |
|---|---|---|---|---|---|---|---|---|---|---|
| | Process speed P (mm/s) | | Transfer current value I (μA) | | I/(P × L) value (where L = 235 mm) | | | | Evaluation of Ghost | |
| | Condition 1 | Condition 2 | Condition 3 | Condition 4 | Conditions 1 + 3 | Conditions 2 + 3 | Conditions 1 + 4 | Conditions 2 + 4 | Initial Ghost | Ghost after 50 kpv |
| Comparative | 198 | 248 | −20 | −50 | −4.30E−04 | −3.43E−04 | −1.07E−03 | −8.58E−04 | 1/1/0/0 | 2/3/0/0 |
| Example 1 | 198 | 248 | −19 | −51 | −4.08E−04 | −3.26E−04 | −1.10E−03 | −8.75E−04 | 2/3/1/1 | 3/3/1/1 |
| Comparative | 198 | 248 | −20 | −50 | −4.30E−04 | −3.43E−04 | −1.07E−03 | −8.58E−04 | 1/1/0/0 | 2/3/0/0 |
| Example 2 | 198 | 248 | −19 | −51 | −4.08E−04 | −3.26E−04 | −1.10E−03 | −8.75E−04 | 2/3/1/1 | 3/3/1/1 |
| Comparative | 198 | 248 | −20 | −50 | −4.30E−04 | −3.43E−04 | −1.07E−03 | −8.58E−04 | 0/0/0/0 | 1/1/0/0 |
| Example 3 | 198 | 248 | −19 | −51 | −4.08E−04 | −3.26E−04 | −1.10E−03 | −8.75E−04 | 0/1/−2/0 | 2/3/−2/0 |
| Example 13 | 198 | 248 | −20 | −50 | −4.30E−04 | −3.43E−04 | −1.07E−03 | −8.58E−04 | 1/1/0/0 | 2/2/0/0 |
| | 198 | 248 | −19 | −51 | −4.08E−04 | −3.26E−04 | −1.10E−03 | −8.75E−04 | 2/3/1/1 | 3/3/1/1 |
| Example 14 | 198 | 248 | −20 | −50 | −4.30E−04 | −3.43E−04 | −1.07E−03 | −8.58E−04 | 1/1/0/0 | 2/2/0/0 |
| | 198 | 248 | −19 | −51 | −4.08E−04 | −3.26E−04 | −1.10E−03 | −8.75E−04 | 2/3/1/1 | 3/3/1/1 |
| Example 15 | 198 | 248 | −20 | −50 | −4.30E−04 | −3.43E−04 | −1.07E−03 | −8.58E−04 | 2/2/−2/−1 | 1/2/−2/−2 |
| | 198 | 248 | −19 | −51 | −4.08E−04 | −3.26E−04 | −1.10E−03 | −8.75E−04 | 2/2/−3/−1 | 2/3/−3/−2 |
| Example 16 | 198 | 248 | −20 | −50 | −4.30E−04 | −3.43E−04 | −1.07E−03 | −8.58E−04 | 1/1/0/0 | 1/2/0/0 |
| | 198 | 248 | −19 | −51 | −4.08E−04 | −3.26E−04 | −1.10E−03 | −8.75E−04 | 2/3/−1/−1 | 2/2/−2/−1 |
| Comparative | 198 | 248 | −20 | −50 | −4.30E−04 | −3.43E−04 | −1.07E−03 | −8.58E−04 | 1/1/0/0 | 2/2/0/0 |
| Example 4 | 198 | 248 | −19 | −51 | −4.08E−04 | −3.26E−04 | −1.10E−03 | −8.75E−04 | 3/3/1/1 | 3/3/1/1 |
| Comparative | 198 | 248 | −20 | −50 | −4.30E−04 | −3.43E−04 | −1.07E−03 | −8.58E−04 | 1/1/0/0 | 2//0/0 |
| Example 5 | 198 | 248 | −19 | −51 | −4.08E−04 | −3.26E−04 | −1.10E−03 | −8.75E−04 | 2/3/1/1 | 3/3/1/1 |
| Example 17 | 198 | 248 | −20 | −50 | −4.30E−04 | −3.43E−04 | −1.07E−03 | −8.58E−04 | 1/1/0/0 | 2/2/0/0 |
| | 198 | 248 | −19 | −51 | −4.08E−04 | −3.26E−04 | −1.10E−03 | −8.75E−04 | 2/3/0/0 | 3/3/0/0 |
| Comparative | 198 | 248 | −20 | −50 | −4.30E−04 | −3.43E−04 | −1.07E−03 | −8.58E−04 | 0/0/−1/−1 | 0/0/−1/−1 |
| Example 6 | 198 | 248 | −19 | −51 | −4.08E−04 | −3.26E−04 | −1.10E−03 | −8.75E−04 | 0/1/0/0 | 0/0/−3/−2 |
| Comparative | 198 | 248 | −20 | −50 | −4.30E−04 | −3.43E−04 | −1.07E−03 | −8.58E−04 | 0/0/−1/−1 | 0/0/−1/−1 |
| Example 7 | 198 | 248 | −19 | −51 | −4.08E−04 | −3.26E−04 | −1.10E−03 | −8.75E−04 | 1/1/−1/−1 | 1/1/−3/−3 |

From the above results, it can be seen that the photoconductors of Examples prevents occurrence of black spots while having a high light sensitivity as compared with the photoconductors of Comparative Examples.

Further, it can be seen that the photoconductors of the Examples have good chargeability.

Moreover, it can also be seen that when an image is formed under conditions satisfying the expression (PIL) by the direct transfer type image forming apparatus provided with the photoconductor of Examples, occurrence of ghosts may be prevented during a period from a beginning to an end of a lifetime of the photoconductor.

Abbreviations in Table 1 mean the following compounds.

Charge Generating Material

CGM-A: V-type hydroxygallium phthalocyanine. Diffraction peaks at Bragg angles (2θ±0.2°) of at least 7.3°, 16.0°, 24.9°, and 28.0° in an X-ray diffraction spectrum using CuKα characteristic X-rays. A maximum peak wavelength of 820 nm in a spectral absorption spectrum in a wavelength range of 600 nm to 900 nm, an average particle diameter of 0.12 μm, maximum particle diameter of 0.2 and a BET specific surface area of 60 $m^2/g$.

Hole Transporting Material

HTM-A: a compound having the following structure, the exemplified compound (HT1-1) of the hole transporting material represented by the general formula (HT1a), and N,N'-diphenyl-N,N'-bis(3-methylphenyl)-[1,1']biphenyl-4,4'-diamine

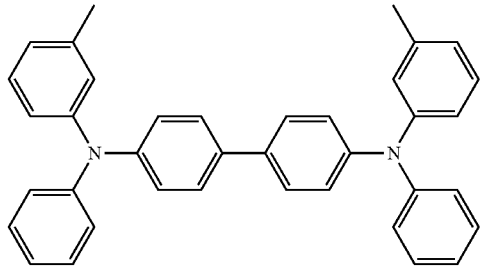

HTM-B: a compound having the following structure

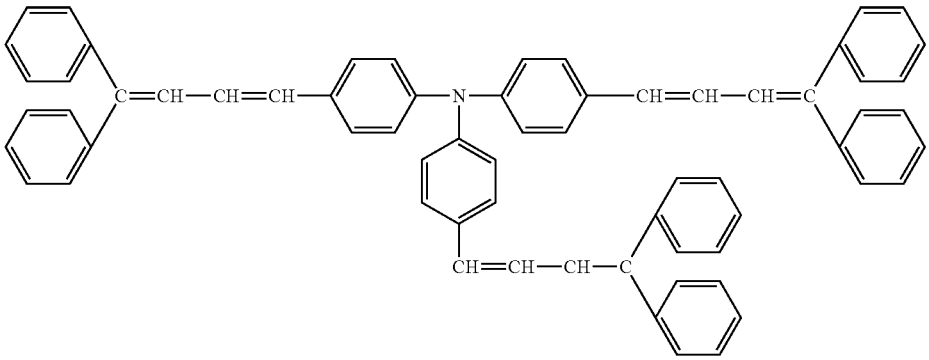

Electron Transporting Material

ETM-A: a compound having the following structure, the exemplified compound (1-1) of the electron transporting material represented by the general formula (FK), and 3,3'-di-tert-butyl-5,5'-dimethyldiphenoquinone

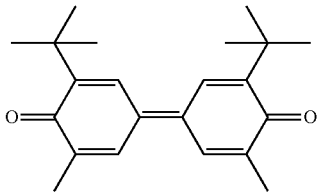

ETM-B: a compound having the following structure

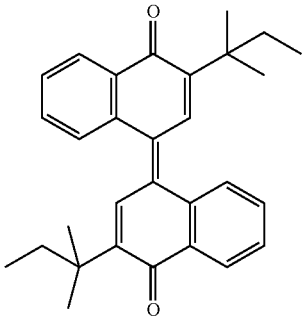

ETM-C: a compound having the following structure

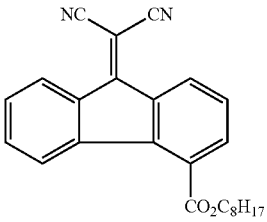

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoconductor comprising:

a conductive substrate; and a single-layer-type photoconductive layer that is provided on the conductive substrate and contains a binder resin, a charge generating material, a hole transporting material, and an electron transporting material, wherein a volume resistivity of the photoconductive layer after wear is $6.5\times10^{10}$ Ω·cm or more and $2.0\times10^{11}$ Ω·cm or less when a ratio of a thickness of the photoconductive layer after wear to a thickness of the photoconductive layer before wear (the thickness of the photoconductive layer after wear/the thickness of the photoconductive layer before wear) is 0.8.

2. The electrophotographic photoconductor according to claim 1, wherein a ratio of the volume resistivity of the photoconductive layer after wear to a volume resistivity of the photoconductive layer before wear (the volume resistivity of the photoconductive layer after wear/the volume resistivity of the photoconductive layer before wear) is 1/100 or more and 7/100 or less.

3. The electrophotographic photoconductor according to claim 1, wherein a mass ratio of the hole transporting material to the electron transporting material (a mass of the hole transporting material/a mass of the electron transporting material) is 19/5 or more and 28/5 or less.

4. The electrophotographic photoconductor according to claim 2, wherein a mass ratio of the hole transporting material to the electron transporting material (a mass of the hole transporting material/a mass of the electron transporting material) is 19/5 or more and 28/5 or less.

5. The electrophotographic photoconductor according to claim 3, wherein a content of the hole transporting material with respect to a total solid content of the photoconductive layer is 38 mass % or more and 44 mass % or less.

6. The electrophotographic photoconductor according to claim 4, wherein a content of the hole transporting material with respect to a total solid content of the photoconductive layer is 38 mass % or more and 44 mass % or less.

7. The electrophotographic photoconductor according to claim 1, wherein the hole transporting material is a hole transporting material having a benzidine skeleton.

8. The electrophotographic photoconductor according to claim 2, wherein the hole transporting material is a hole transporting material having a benzidine skeleton.

9. The electrophotographic photoconductor according to claim 3, wherein the hole transporting material is a hole transporting material having a benzidine skeleton.

10. The electrophotographic photoconductor according to claim 4, wherein the hole transporting material is a hole transporting material having a benzidine skeleton.

11. The electrophotographic photoconductor according to claim 5, wherein the hole transporting material is a hole transporting material having a benzidine skeleton.

12. The electrophotographic photoconductor according to claim 6, wherein the hole transporting material is a hole transporting material having a benzidine skeleton.

13. The electrophotographic photoconductor according to claim 7, wherein the hole transporting material having the benzidine skeleton is a hole transporting material represented by the following general formula (HT1a):

(HT1a)

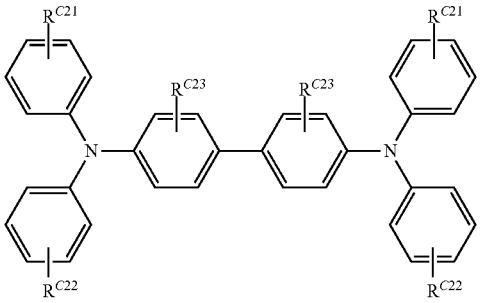

in the general formula (HT1a), $R^{C21}$, $R^{C22}$, and $R^{C23}$ each independently represent a hydrogen atom, a halogen atom, an alkyl group having 1 or more and 10 or less carbon atoms, an alkoxy group having 1 or more and 10 or less carbon atoms, or an aryl group having 6 or more and 10 or less carbon atoms.

14. The electrophotographic photoconductor according to claim 8, wherein the hole transporting material having the benzidine skeleton is a hole transporting material represented by the following general formula (HT1a):

(HT1a)

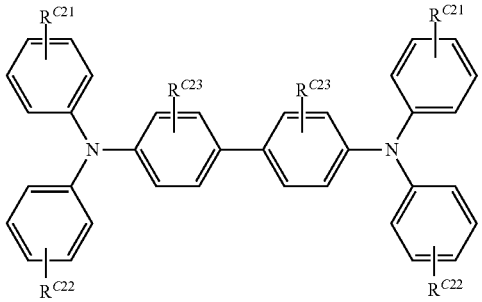

in the general formula (HT1a), $R^{C21}$, $R^{C22}$, and $R^{C23}$ each independently represent a hydrogen atom, a halogen atom, an alkyl group having 1 or more and 10 or less carbon atoms, an alkoxy group having 1 or more and 10 or less carbon atoms, or an aryl group having 6 or more and 10 or less carbon atoms.

15. The electrophotographic photoconductor according to claim 1, wherein the electron transporting material is an electron transporting material having a diphenoquinone skeleton.

16. The electrophotographic photoconductor according to claim 15, wherein the electron transporting material having the diphenoquinone skeleton is an electron transporting material represented by the following general formula (FK):

(FK)

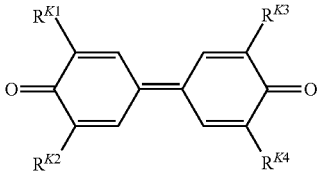

in the general formula (FK), $R^{k1}$ to $R^{k4}$ each independently represent a hydrogen atom, an alkyl group having 1 or more and 12 or less carbon atoms, an alkoxy group having 1 or more and 12 or less carbon atoms, a cycloalkyl group, an aryl group, or an aralkyl group.

17. A process cartridge comprising:

the electrophotographic photoconductor according to claim 1, wherein the process cartridge is configured to be attached to and detached from an image forming apparatus.

18. An image forming apparatus comprising:

the electrophotographic photoconductor according to claim 1;

a charging unit configured to charge a surface of the electrophotographic photoconductor;

an electrostatic latent image forming unit configured to form an electrostatic latent image on the charged surface of the electrophotographic photoconductor;

a developing unit configured to develop, by using a developer containing a toner, the electrostatic latent image formed on the surface of the electrophotographic photoconductor so as to form a toner image; and a transfer unit configured to transfer the toner image onto a surface of a recording medium.

19. An image forming apparatus comprising:

the electrophotographic photoconductor according to claim 1;

a charging unit configured to charge a surface of the electrophotographic photoconductor;

an electrostatic latent image forming unit configured to form an electrostatic latent image on the charged surface of the electrophotographic photoconductor;

a developing unit configured to develop, by using a developer containing a toner, the electrostatic latent image formed on the surface of the electrophotographic photoconductor so as to form a toner image; and a direct transfer type transfer unit including a transfer member configured to transfer the toner image directly from the electrophotographic photoconductor to a surface of a recording medium, wherein a relationship among a rotation speed P (mm/s) of the electrophotographic photoconductor, a transfer current value I (μA) for transferring the toner image directly from the electrophotographic photoconductor to the surface of the recording medium, and a length L (mm) of the transfer member satisfies the following expression (PIL):

$$-1.07\times10^{-3}\leq I/(P\times L)\leq-4.30\times10^{-4}. \quad \text{expression (PIL):}$$

20. The electrophotographic photoconductor according to claim 1, wherein the volume resistivity of the photoconductive layer after wear is $8.0\times10^{10}$ Ω·cm or more and $2.0\times10^{11}$ Ω·cm or less.

* * * * *